US007364443B1

(12) United States Patent
McGinnis et al.

(10) Patent No.: US 7,364,443 B1
(45) Date of Patent: Apr. 29, 2008

(54) RETRACTABLE ELECTRICAL POWER OUTLET DEVICE

(76) Inventors: Glenn M. McGinnis, 4902 Mirabella Pl., Lutz, FL (US) 33585; John F. Coyne, 212 St. James Ct., Mechanicsburg, PA (US) 17050

( * ) Notice: Subject to any disclaimer, the term of this patent is extended or adjusted under 35 U.S.C. 154(b) by 0 days.

(21) Appl. No.: 11/435,257

(22) Filed: May 16, 2006

Related U.S. Application Data

(60) Provisional application No. 60/727,184, filed on Oct. 17, 2005.

(51) Int. Cl.
*H01R 13/44* (2006.01)

(52) U.S. Cl. ..... 439/131; 439/534; 439/535

(58) Field of Classification Search ..... 174/48; 439/131, 528, 535, 534, 373, 467, 596
See application file for complete search history.

(56) References Cited

U.S. PATENT DOCUMENTS

| | | | | |
|---|---|---|---|---|
| 6,085,667 | A * | 7/2000 | Gevaert et al. | 108/50.02 |
| 6,290,518 | B1 * | 9/2001 | Byrne | 439/131 |
| 2005/0130467 | A1 * | 6/2005 | Sharples | 439/131 |

* cited by examiner

*Primary Examiner*—Tho D. Ta
*Assistant Examiner*—Travis Chambers
(74) *Attorney, Agent, or Firm*—Edward P Dutkiewicz

(57) ABSTRACT

An electrical outlet device comprising a mounting plate and an electrical outlet assembly containing electrical components and a hinge assembly coupled to the electrical outlet assembly and the mounting plate and adapted to enable the electrical outlet assembly to pivot with respect to the mounting plate between a raised horizontal orientation and a lowered operative orientation.

19 Claims, 22 Drawing Sheets

RETRACTABLE ELECTRICAL POWER OUTLET DEVICE

RELATED APPLICATION

This U.S. patent application is based upon Provisional Patent Application Ser. No. 60/727,184 filed Oct. 17, 2005.

BACKGROUND OF THE INVENTION

1. Field of the Invention

The present invention relates to a retractable electrical power outlet device and more particularly pertains to mounting electrical components beneath horizontal surfaces and folding them out of sight when not in use.

2. Description of the Prior Art

The use of outlet assemblies of known designs and configurations is known in the prior art. More specifically, outlet assemblies of known designs and configurations previously devised and utilized for the purpose of providing access to electricity through known methods and apparatuses are known to consist basically of familiar, expected and obvious structural configurations, notwithstanding the myriad of designs encompassed by the crowded prior art which has been developed for the fulfillment of countless objectives and requirements.

By way of example, U.S. Pat. No. 5,122,069 issued Jun. 16, 1992 to Brownlie relates to an access flooring module. U.S. Pat. No. 5,342,993 issued Aug. 30, 1994 to Siems relates to a weather-proof floor outlet method. U.S. Pat. No. 5,575,668 issued Nov. 19, 1996 to Timmerman relates to a temporary power/data tap. Lastly, U.S. Pat. No. 6,979,209 issued Dec. 27, 2005 to Griepentrog relates to a biased utility receptacle assembly.

While these devices fulfill their respective, particular objectives and requirements, the prior patents do not describe retractable electrical-power outlet device that allows for mounting electrical components beneath horizontal surfaces and folding them out of sight when not in use.

In this respect, the retractable electrical power outlet device according to the present invention substantially departs from the conventional concepts and designs of the prior art and in doing so provides an apparatus primarily developed for the purpose of mounting electrical components beneath horizontal surfaces and folding them out of sight when not in use.

Therefore, it can be appreciated that there exists a continuing need for a new and improved retractable electrical power outlet device which can be used for mounting electrical components beneath horizontal surfaces and folding them out of sight when not in use. In this regard, the present invention substantially fulfills this need.

SUMMARY OF THE INVENTION

In view of the disadvantages inherent in the known types of outlet assemblies of known designs and configurations now present in the prior art, the present invention provides an improved retractable electrical power outlet device. As such, the general purpose of the present invention, which will be described subsequently in greater detail, is to provide a new and improved retractable electrical power outlet device and method which has all the advantages of the prior art and none of the disadvantages.

To attain this, the present invention essentially comprises a retractable electrical power outlet device which mounts beneath horizontal surfaces and folds out of sight when not in use. The device comprises a base mounting plate, which provides attachment to a mounted surface and an electrical power outlet assembly containing a plurality of electrical outlet sockets positioned on the end of the assembly. A hinge assembly enables the outlet assembly to swing downward from a forward facing horizontal position. Also provided is an electrical power input connector and an electrical power output-connector which allows interconnection to another concealable outlet device. A locking mechanism retains the outlet assembly in the horizontal position. Lastly provided is a hinged safety cover which guards against accidental contact with the electrical outlets when the device is not in use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved retractable electrical power outlet device which has all of the advantages of the prior art electrical outlet devices and none of the disadvantages.

It is another object of the present invention to provide a new and improved retractable electrical power outlet device which may be easily and efficiently manufactured and marketed.

It is further object of the present invention to provide a new and improved retractable electrical power outlet device which is of durable and reliable constructions.

An even further object of the present invention is to provide a new and improved retractable electrical power outlet device which is susceptible of a low cost of manufacture with regard to both materials and labor, and which accordingly is then susceptible of low prices of sale to the consuming public, thereby making such retractable electrical power outlet device economically available to the buying public.

Even still another object of the present invention is to provide a retractable electrical power outlet device for mounting electrical components beneath horizontal surfaces and folding them out of sight when not in use.

Lastly, it is an object of the present invention to provide a new and improved electrical outlet device comprising a mounting plate and an electrical outlet assembly containing electrical components and a hinge assembly coupled to the electrical outlet assembly and the mounting plate and adapted to enable the electrical outlet assembly to pivot with respect to the mounting plate between a raised horizontal orientation and a lowered operative orientation.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 C is an isometric view of the device described by FIG. 10B with the addition of an electrical fixture and cover plate.

The same reference numerals refer to the same parts throughout the various Figures.

DESCRIPTION OF THE PREFERRED EMBODIMENT

Figure 1:
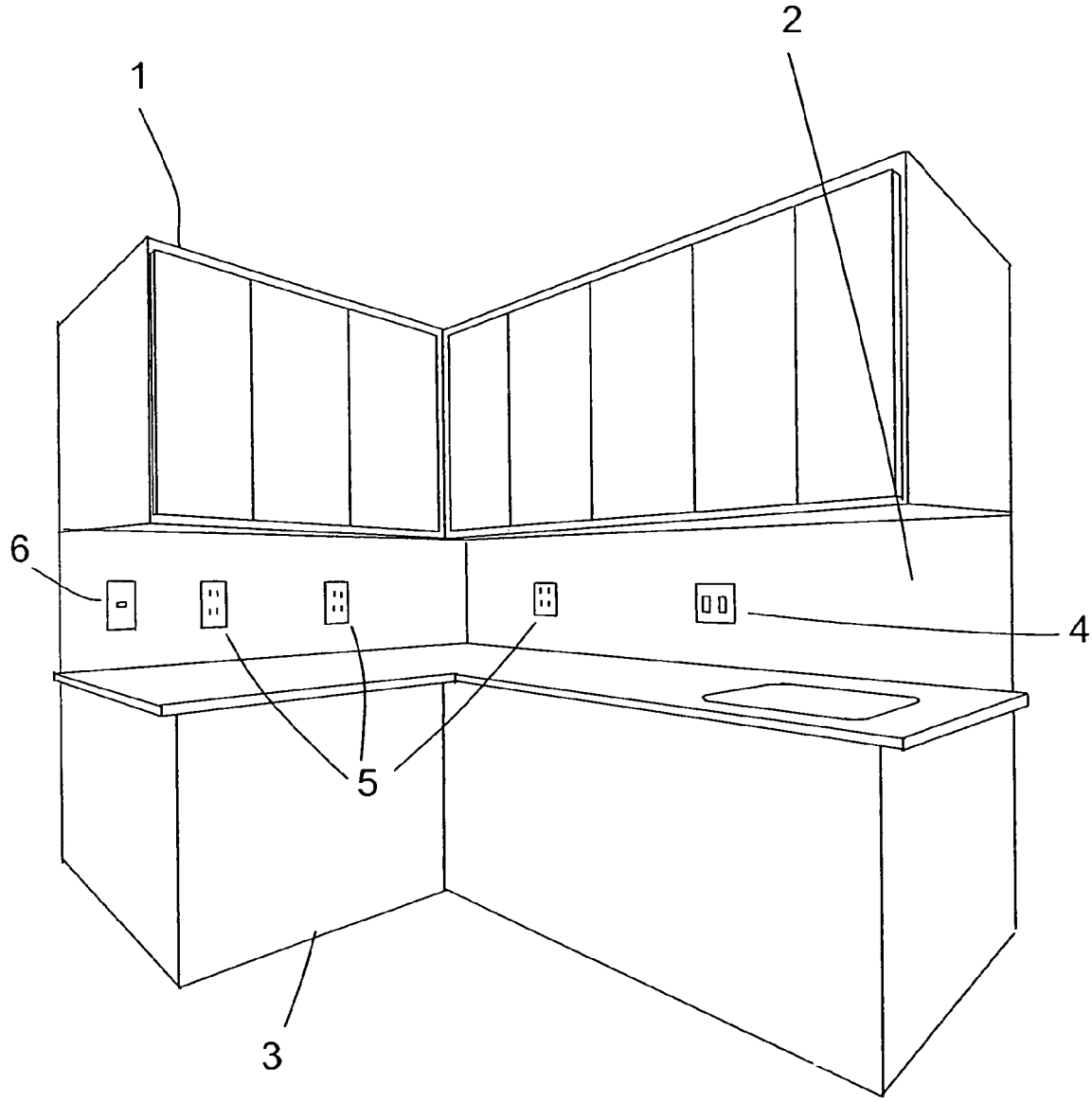
FIG. 1 is a perspective drawing of the existing state of the art of placing electrical outlets and interfaces insofar as they are installed in the kitchen.

With reference now to the drawings, and in particular to FIG. 1 thereof, the preferred embodiment of the new and improved retractable electrical power outlet device embodying the principles and concepts of the present invention and generally designated by the reference numeral 10 will be described.

The present invention, the retractable electrical power outlet device is comprised of a plurality of components. Such components in their broadest context include a base mounting plate, an electrical power outlet assembly, a hinge assembly, an electrical power input connector, and electrical power output connector, a locking mechanism and a safety cover. Such components are individually configured and correlated with respect to each other so as to attain the desired objectives.

The detailed description is organized into the following sections, each describing a type of concealable electrical interface: Concealable Electrical Power Outlets, Concealable Multi-Purpose under Cabinet Lights, Concealable Electrical Switches and Dimming Devices, Concealable Communications Interface Connection Points, and Concealable Radio Frequency Remote Controller Mounts.

General topic applicable to some, or all, of the above concealable interface types include various Electrical Connections.

Concealable Electrical Power Outlets are a class of devices which are offered in multiple basic embodiments. Different embodiments are dictated by length of usage repeated plugging and un-plugging vs. permanent or long term, electrical line cord placement and visibility, ease of use, available space and allowable device thickness. In general, embodiments intended for long-term use place the connected electrical line cords near the counter backsplash or distant from the front of the horizontal surface to which the embodiment is affixed. Ease of use is influenced by factors such as design for one handed plugging and unplugging. Device thickness can be minimized by positioning the electrical power outlets on their side with the blades oriented from left to right instead of top to bottom. Other differentiators between embodiments include the substation of a GFCI device or a surge suppression device and the method used to connect the devise to premise power. Connection methods include hard wiring, modular connectors and a conventional 120 V AC plug installed on the rear of the device.

Figure 11:
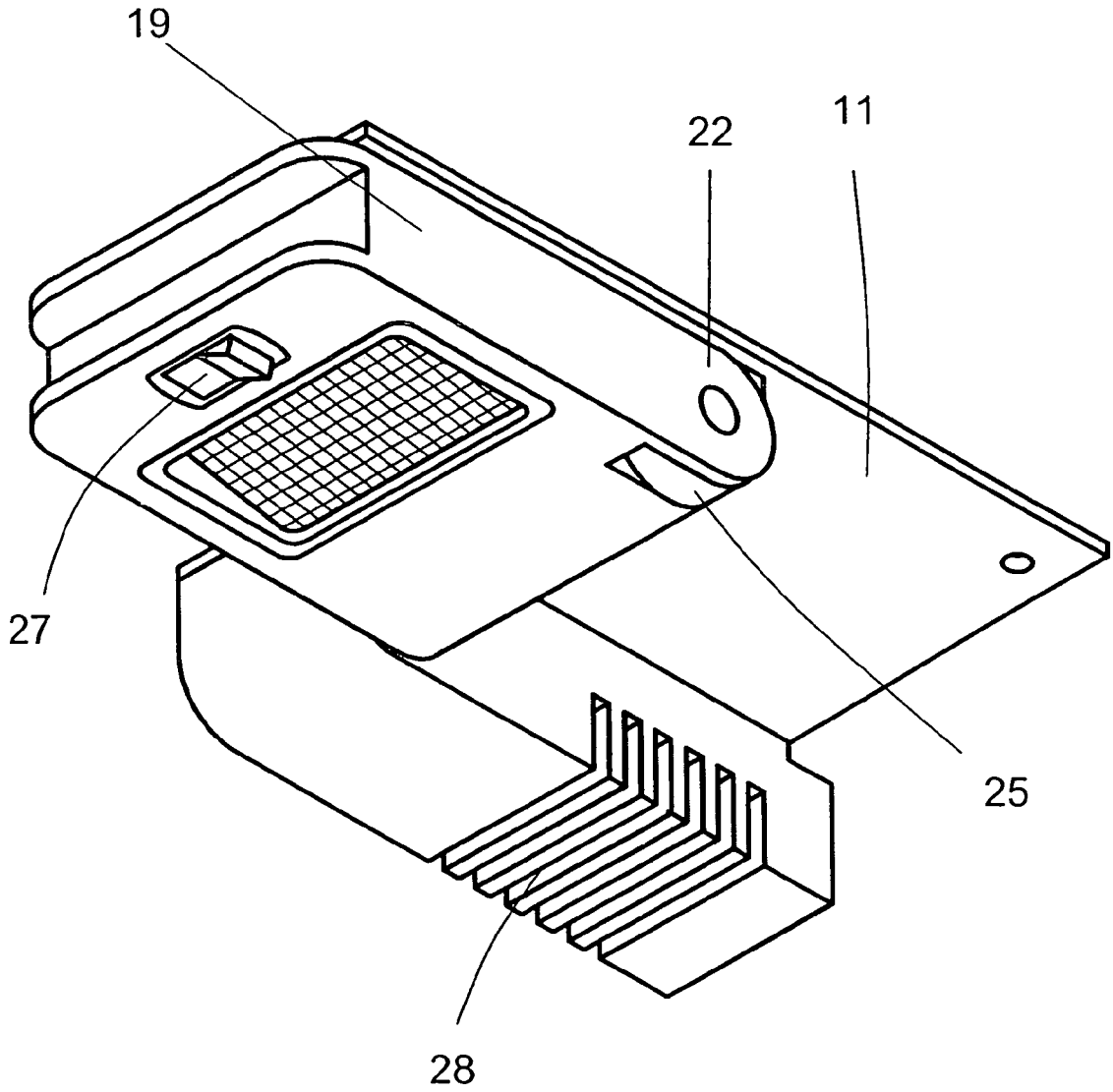
FIG. 11 is an isometric view of a hinged electrical lighting device which provides countertop work area illumination in one position under-cabinet accent lighting when pivoted to the other position

Concealable Multi-Purpose under cabinet lights is another basic embodiment of this class of device which is illustrated in FIG. 11. An electrical lighting module 19 is used in place of the outlet assembly that is used in other embodiments that provide outlet box capabilities. An electrical light source being Light Emitting Diodes, Halogen, Incandescent, fluorescent or other light source type is positioned within the electrical light module. When the electrical lighting module is positioned in the forward horizontal position the light would be projected downward toward the counter top and serves as a task light. As the electrical lighting module is pivoted to the 90-degree or vertical position, the lighting is redirected to the backsplash. Rotating the electrical lighting module past the vertical position will redirect the light upward and will ultimate cause light to be reflected off of the cabinet bottom and infuse the under cabinet area with indirect light. The effect and influence of the lighting variations can be further embellished with the addition of a dimming rheostat on the lighting fixture or on a common switch if multiple Concealable multi-purpose under counter Lights are used as a group.

Concealable Electrical Switches and Dimming Devices include a Concealable electrical switch or Dimming device which uses any embodiment of the Concealable Electrical Power Outlet Device that provides outlet box capabilities. The moveable assembly 13 can contain any standard electrical device manufactured for an outlet box including but not limited to light dimmers, fan switches, 911 dialers, mechanical electrical switches and the like.

Concealable Communications Interface Connection Points is a class of device which offers a connection point to common household interfaces such as an RJ-11 telephony port, a RJ-42 Internet port or a television signal co-axial port. This class of device would be another embodiment of the Concealable Electrical Power Outlet Device depicted in FIG. 6.

Concealable Radio Frequency Remote Controller Mounts is a class of device that is used to hold and store various types of remote controllers that may be used to control Televisions, Sound Systems, Remotely toggled electrical power control, Ceiling fan controllers or any other battery operated controller that would benefit from always being in a known place and position. The controller would be affixed via hook and loop fasteners or by two sided tape or any adhesive supplied with the remote device to be attached and can be removed for use or left in place on the Controller mount when used.

All device classes and embodiments that interconnect with premise power or premise circuits such as lighting or fan circuits will contain minor embodiments to permit interconnection via electrical three wire pigtails or via modular connectors.

All internal wiring utilized in any electrical embodiment of any device will utilize extremely flexible high strand count wires to facilitate a large number of repetitive duty cycles. All bends will be torsion with the actual twisting to take place over a long segment of wire in order to minimize stress and fatigue.

FIG. 1 illustrates the typical use of the present state of the art of providing electrical outlets 5, electrical switches 4 and coaxial or telephone connections 6 in the typical kitchen environment. A common kitchen implementation will feature upper cabinets 1 and lower cabinets 3. When the cabinets are wall mounted there will be a backsplash 2 surface between them. The Installation of the aforementioned electrical devices is accomplished by cutting holes in the backsplash 2 material, which can be anything from a granite slab to painted drywall and connecting the device to the signal cable or the buildings electrical power circuit. The various type of electrical interfaces are then decorated with switch or outlet plates in order to make them more pleasing to the eye and cover any exposed wiring or mechanical paraphernalia.

Figure 2:
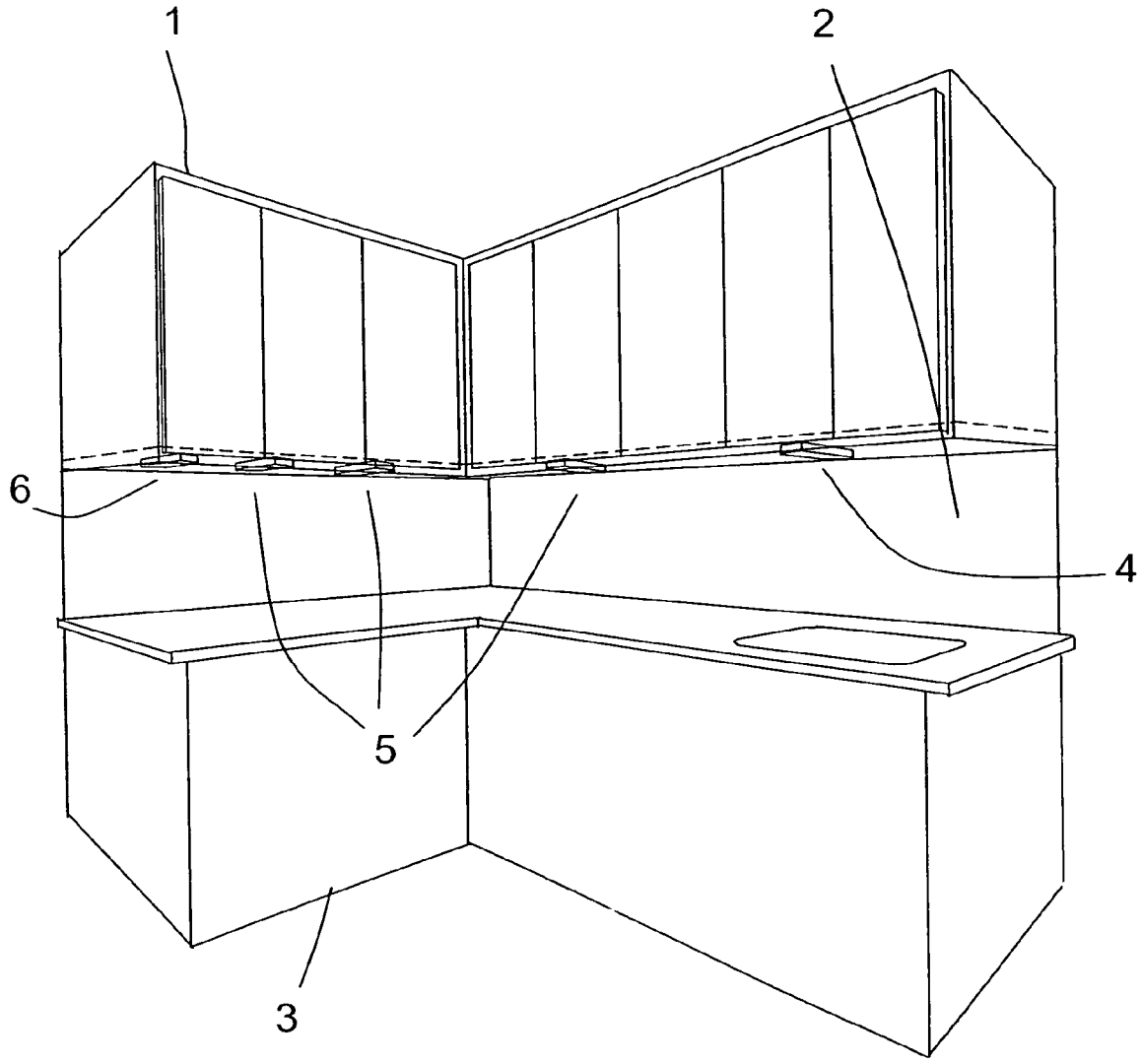
FIG. 2 is a perspective drawing illustrating how the same kitchen illustrated in FIG. 1 would appear if the devices described herein were used.

FIG. 2 illustrates how the same kitchen environment might appear when various embodiments of the concealable electrical interfaces are used in lieu of the interfacing devices offered by the present state of the art. In this drawing, various embodiments of concealable electrical interface devices would be used to accomplish the replacement of the electrical outlets, switches and coaxial cable contained in FIG. 1. The various embodiments will be further explained in subsequent drawings.

Figure 2A:
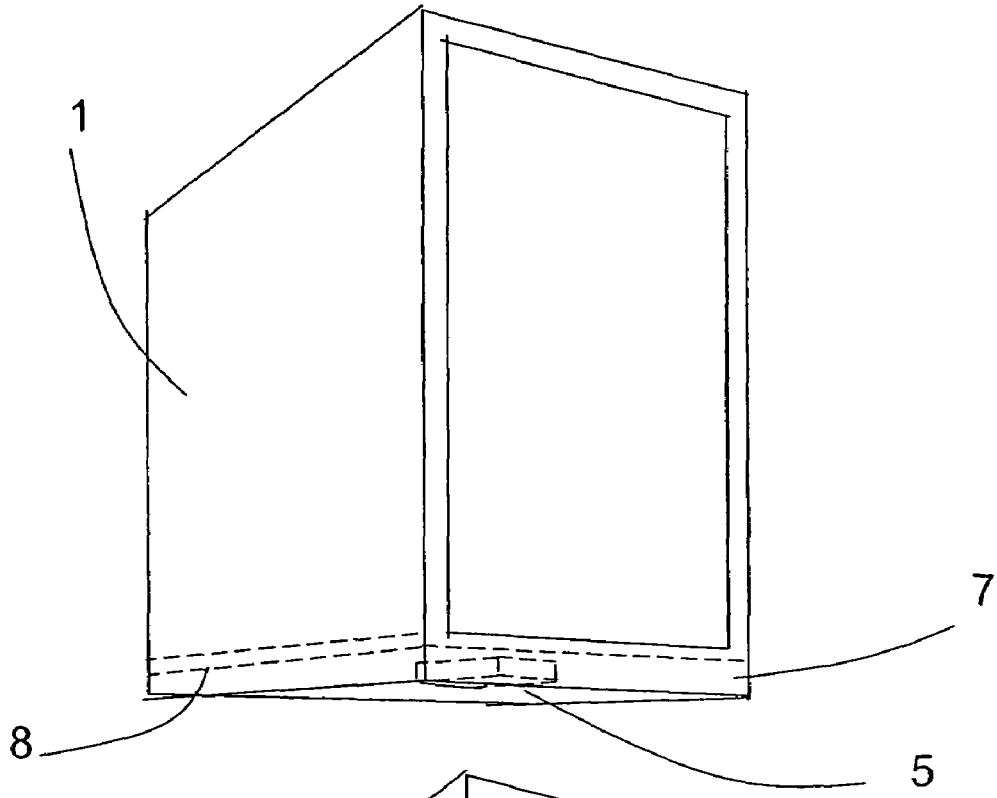
FIG. 2A is a perspective drawing illustrating how the typical cabinet bottom trim is used to conceal one of the concealable electrical fixtures.

FIG. 2A illustrates the installation of a concealable interfacing device 5 on an upper kitchen cabinet 1 with bottom trim installed at the front and sides 7. The trim typically extends below the lower surface of the cabinet bottom to conceal the illustrated concealable electrical interfacing device 5.

When the term conceal is used it is a relative term in that the various embodiments herein are far less visible than the present embodiments of the present state of the art.

Some of the embodiments of the concealable interfacing devices herein are usually in a horizontal state. Other embodiments, which are suitable for short-term task usage are in a vertical position only when they are being used.

The design of all embodiments is such that they would not be viewable by most people who are standing. If desired, the bottom cabinet trim can be modified so as to render it deeper and thus even further reduce the visibility of any concealed electrical devices that might be present.

Figure 2B:
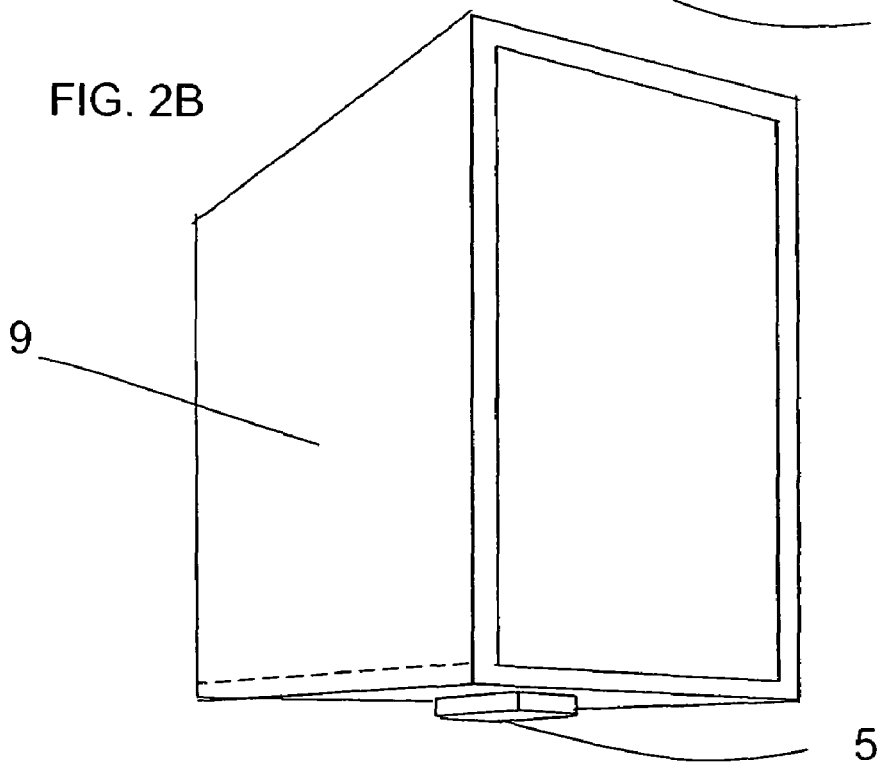
FIG. 2B is a perspective drawing illustrating how a concealable electrical interface fixture would appear when attached to a cabinet that does not have bottom trim.

FIG. 2B illustrates the installation of a concealable interfacing device 5 on an upper kitchen cabinet bottom 9 with no bottom trim on the front or sides. This style will provide less concealment for attached concealable interfacing devices 5 than would be available with bottom and side trim.

Even without bottom and side trim the overall appearance presented by the use of concealable electrical interfacing devices is far superior to the present state of the art as there are no holes or mechanisms on the backsplash surfaces beneath the cabinet.

Figure 3:
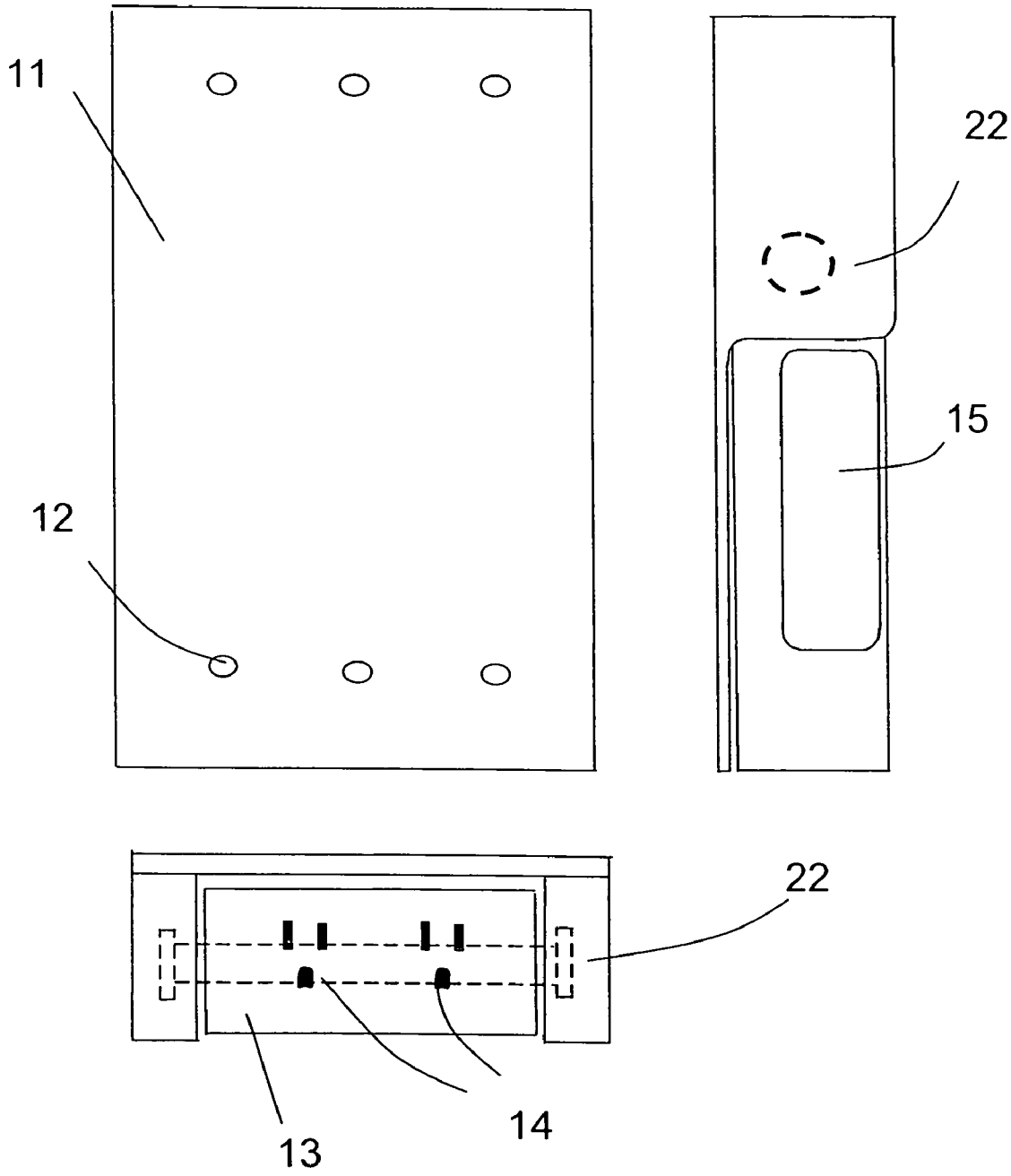
FIG. 3 is a three view drawing of a primary embodiment of the hinged electrical power outlet device suitable for short-term use in the un-used or closed position.

FIG. 3 is a three-view top, front and right side drawing of a primary embodiment of the hinged electrical power outlet device suitable for short-term use in the closed or unused position. The left side is omitted as it is a mirror image to the right side. The base mounting plate 11 contains mounting screw holes 12, which are used to effect a mechanical connection between the base mounting plate and the lower surface of the cabinet bottom. The front of the electrical power outlet assembly 13 shows the placement of two electrical power outlet sockets 14 offered by this embodiment. The electrical power out assembly pivots about the pivot shaft 22. This illustration contains two standard polarized 110-volt outlet plugs as used in the United States and Canada. All devices in this application that contain electrical outlets are also intended to offer outlet types suitable to comply with the standards and code requirements of other countries. The fingertip openings 15 as illustrated in the side view are placed on both sides of the electrical power outlet assembly 13 to allow a user to pivot the outlet assembly while keeping their fingers distant from the electrical outlet sockets 14. The electrical outlet sockets 14 depicted in this view are oriented such that their blades are vertically oriented. A minor embodiment of this device includes electrical outlet sockets 14 with the blades oriented horizontally in order to further reduce the overall height of the electrical power outlet assembly 13.

Figure 4:
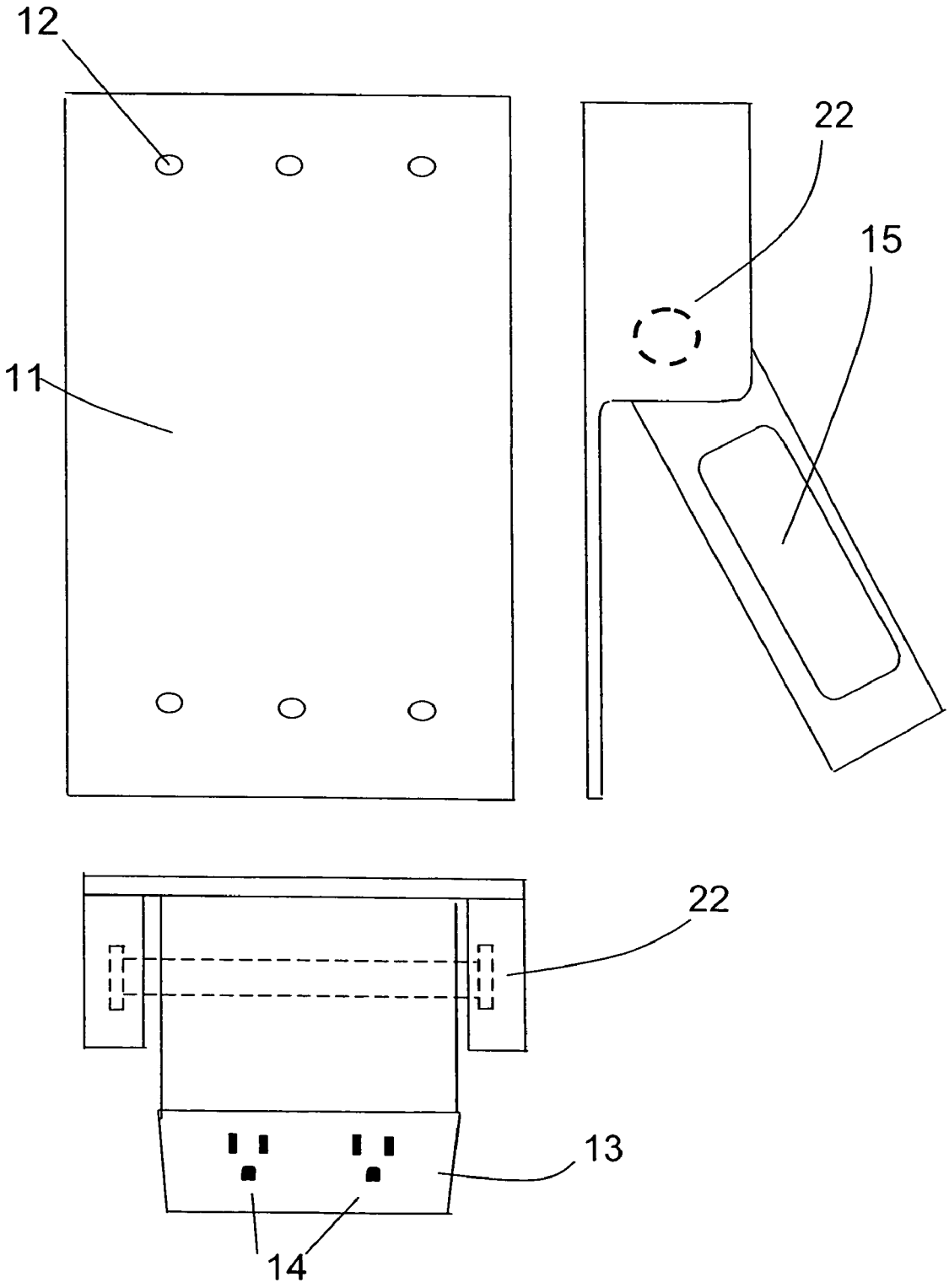
FIG. 4 is a three view drawing of the same embodiment of the hinged electrical power outlet device suitable for short-term use in the open position.

FIG. 4 is a three-view top, front and right side drawing of a primary embodiment of the hinged electrical power outlet device suitable for short-term use in the open or used position. When it is desired to plug in an electrical line cord the operator grasps the electrical power outlet assembly 13 by the fingertip openings 15 and pulls downward causing the assembly to rotate about the pivot shaft 22.

The angled design is offered in all embodiments of the short-term usage devices to better facilitate the higher number of plugging and unplugging cycles anticipated for this use as the plug is inserted directly toward the hinge assembly. Thus there is a reduced tendency for repetitious use to loosen the device mounting screws or cause excessive wear on the pivot mechanism.

Figure 4A:
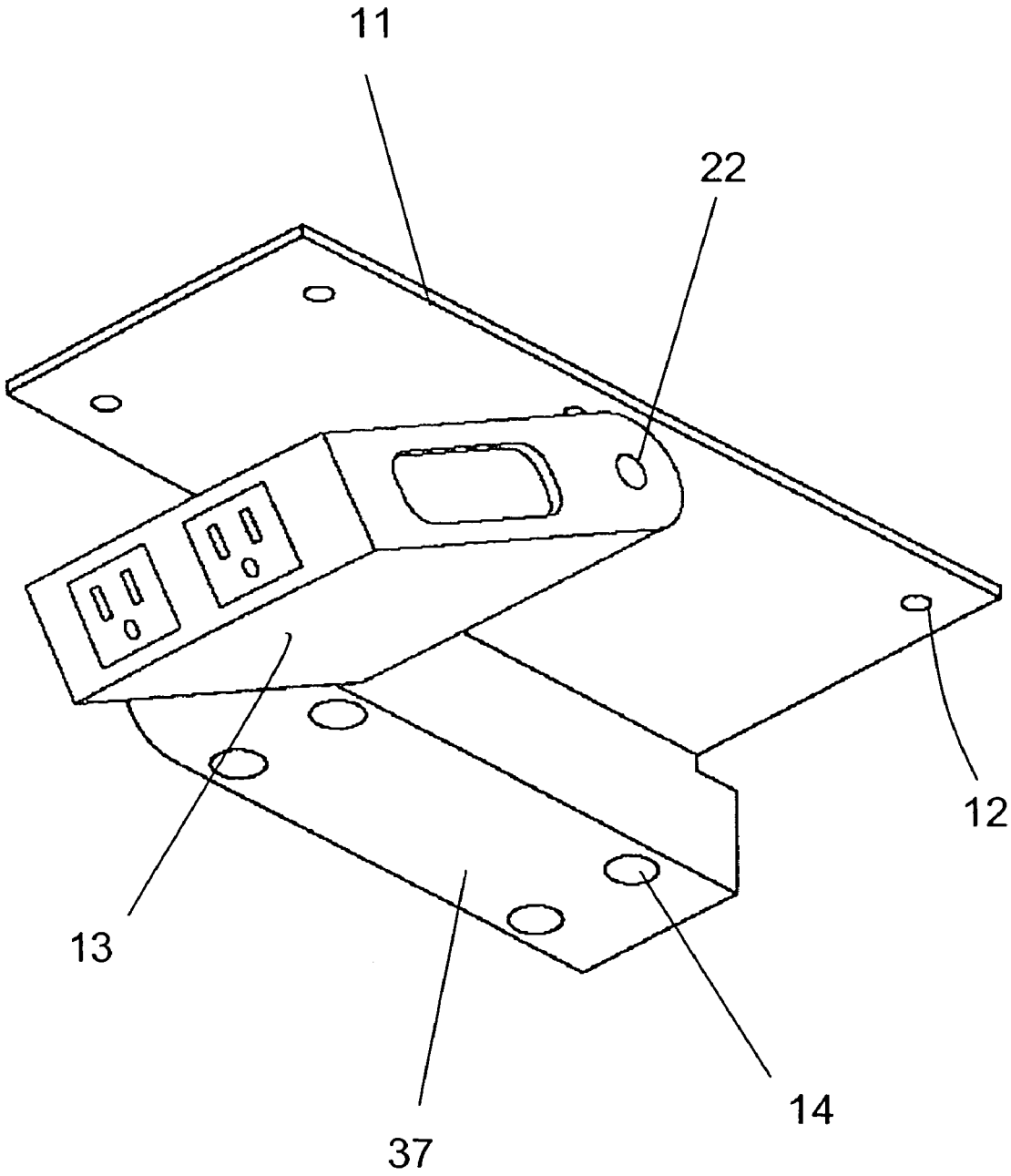

FIG. 4A is an isometric view of another embodiment of the outlet device suitable for short-term use in the open or usable position. This embodiment offers a base mounting plate 11, which is attached to the desired surface with adhesives or by using screws passing through the mounting screw holes 12 in the same fashion as previous embodiments. All electrical connectors needed to provide electrical power to the assembly and pass power to an adjacent assembly as well as the hinge assembly anchor are positioned within the support module 37, which is affixed to the base mounting plate 11. Mounting screw access holes 14 permit mounting screws to pass through the support module 13. This ensures that this portion of the device is firmly affixed to the desired mounting surface in order to resist any movement due to forces imparted when the electrical power outlet assembly 13 is pivoted. The pivot shaft 22 extends from the support module 37 and serves as the mounting mechanism for the electrical power outlet module 13.

Figure 5:
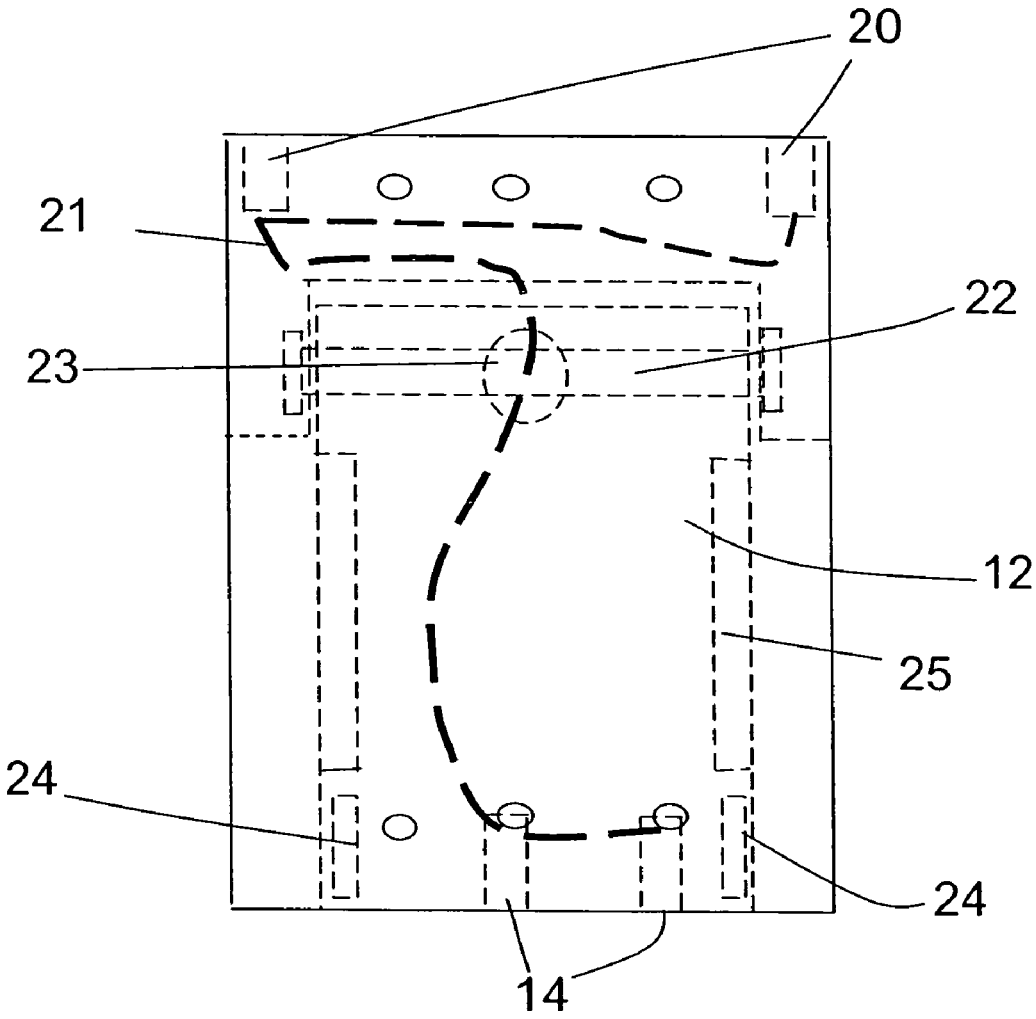
FIG. 5 is a top view including interior detail of the primary embodiment of the hinged electrical power outlet device suitable for short-term

FIG. 5 is a top view including interior detail of the primary embodiment of the hinged electrical power outlet device suitable for short-term use. Two modular electrical plugs 20 are included within the design. Both connectors are wired in common to each other as well as to both electrical power outlets. Thus, either connector can be used to receive incoming premise electrical power. The second connector plug 20 may be optionally utilized to supply electrical power to an additional power outlet device. Braided three conductor electrical wire 21 is used to interconnect both modular electric plugs 20 as well as both front mounted electrical power outlets 14. The three-conductor wire is routed through an opening 4 into the interior of the electrical power outlet assembly 13. Fingertip openings 15 are provided on both sides of electrical power outlet assembly 13 to provide a gripping point for the user. The electrical power outlet assembly 13 circumscribes a 45-degree arc about the electrical power outlet assembly pivot shaft 22. Two permanent magnets 24 are used to keep the electrical power outlet assembly 13 in a horizontal position against the bottom surface of the base mounting plate 11 when the device is not in use.

Another embodiment of the hinged electrical power outlet device suitable for short-term use includes of an un-terminated three-wire cable assembly pre-attached to the device in place of a modular connector.

Figure 5A:
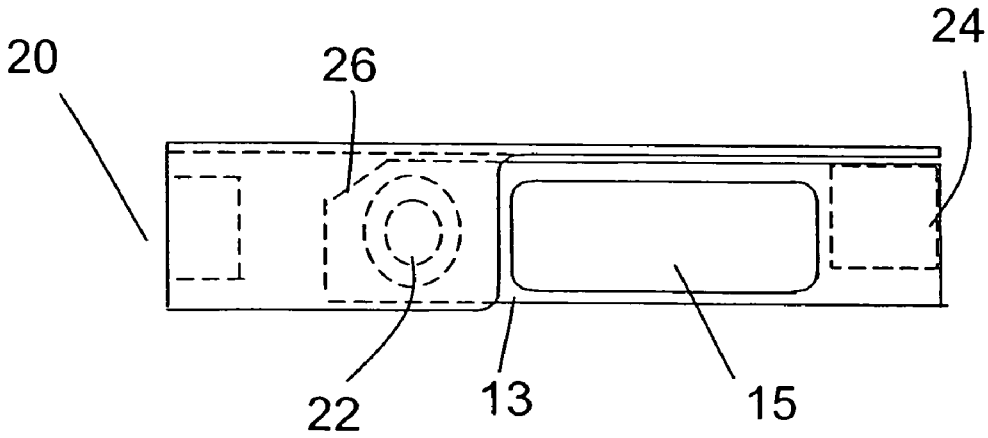
FIG. 5A is a right-side view including interior detail of the primary embodiment of the hinged electrical power outlet device suitable for short-term use.

FIG. 5A is a right-side view including interior detail of the primary embodiment of the hinged electrical power outlet device suitable for short-term use. The electrical power outlet assembly 13 has an angular surface 26, which abuts the bottom surface of the base mounting plate 11 to limit the rotational movement of the electrical power outlet assembly to 45 degrees.

Figure 6:
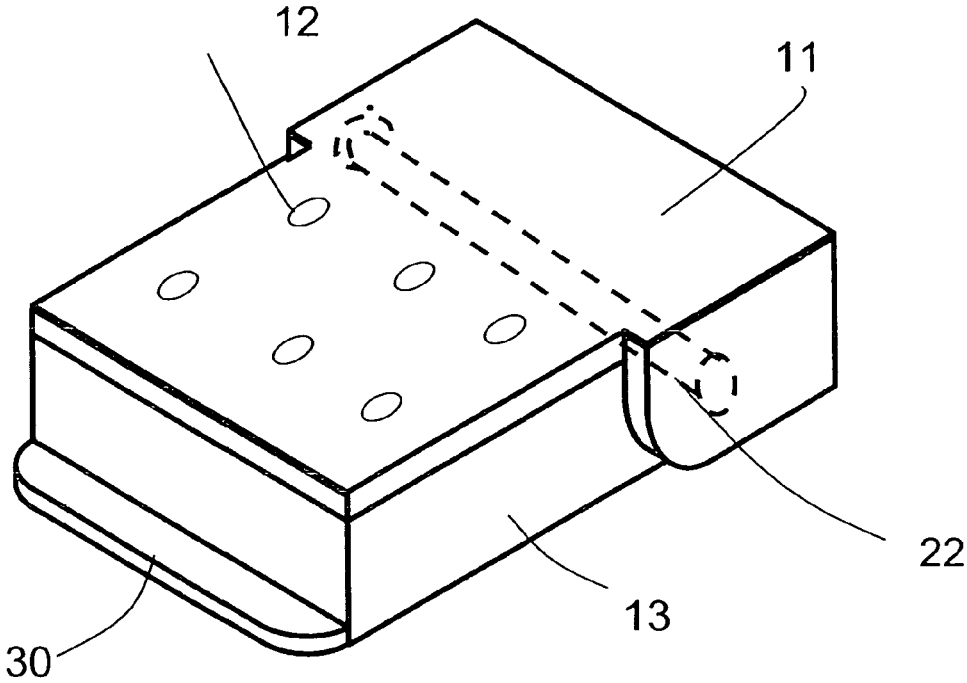
FIG. 6 contains an isometric view of a basic embodiment of a hinged electrical power outlet device suitable for long-term use in the closed or unused position.

FIG. 6 illustrates the hinged electrical power outlet device suitable for long-term usage. This base mounting plate 11 of this embodiment attaches to the underside or bottom of a cabinet and can be attached mechanically with screws passing through the mounting holes 12 or adhesively with double-sided construction tape. The electrical power outlet assembly 13 can be opened and closed by pivoting it about the pivot shaft 22 using the front handle 30. Two 110 Volt, three prong polarized plugs 14 are positioned on the face of the electrical power outlet assembly 13.

Figure 6A:
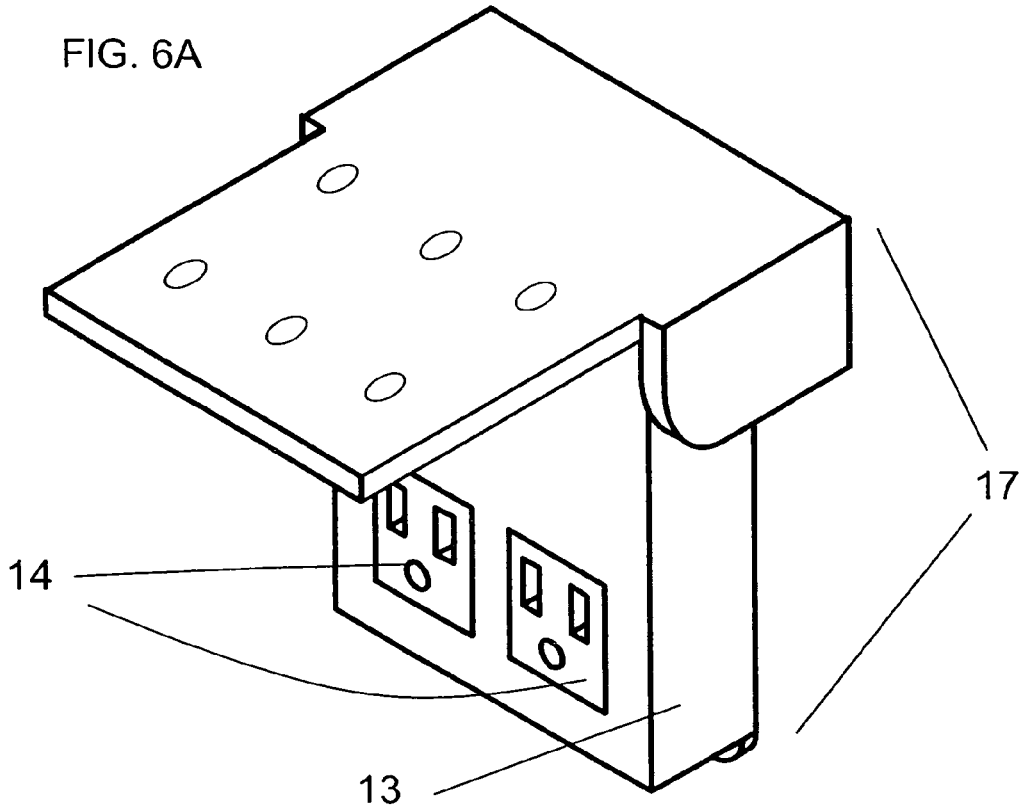
FIG. 6A contains an isometric view of a basic embodiment of a hinged electrical power outlet device suitable for long-term use in the open or used position.

FIG. 6A is the same embodiment represented in FIG. 6 with the electrical power outlet assembly 13 pivoted downward 90 degrees. Although the device can be positioned anywhere under a cabinet, it is recommended that it be positioned toward the back of the cabinet. Positioning the device toward the back allows the electrical power outlet assembly 13 to be located near the backsplash, which makes the device less intrusive and avoids any access restriction to the countertop task area. When in use, the device is placed in the position shown. One or two electrical line cords can then be placed within the electrical power outlet modules 14. If use of the device is no longer required, the electrical plugs are extracted and the electrical power outlet assembly 13 can be rotated forward to a horizontal position. A critical design point of each embodiment of all of the hinged electrical power outlet devices described within this application is the overall distance 17 the electrical plug descends beneath the surface to which the device is attached when the device is rotated to the vertical position. While it is desirable to conceal the device as much as practical while the electrical power outlet assembly 13 is in a horizontal attitude, it is likewise desirable to ensure a user can clearly see the assembly when it is placed in the vertical position to aid and assist their ability to insert and remove electrical power line cords.

Figure 7:
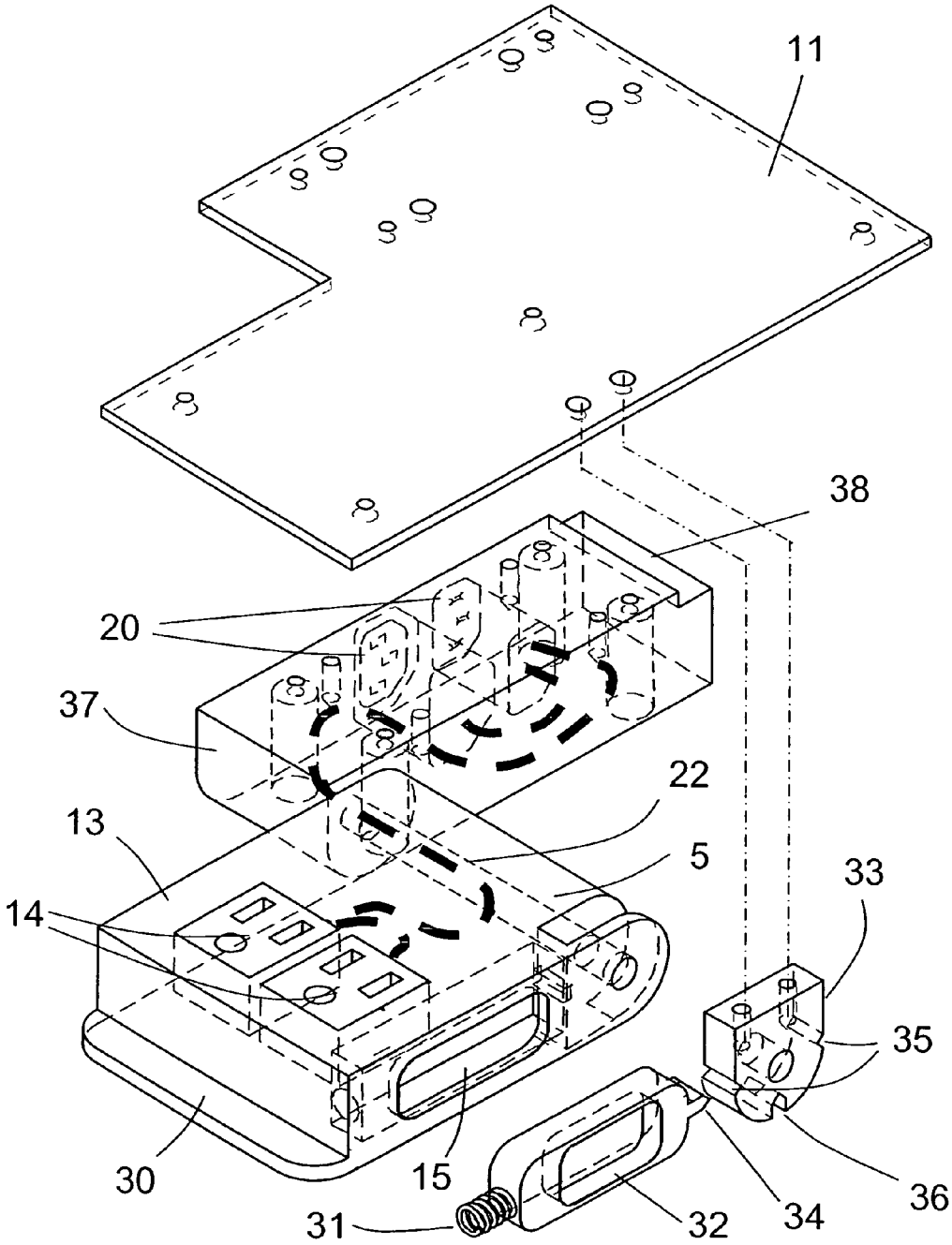
FIG. 7 is an exploded view with internal details of a folding electrical power outlet device suitable for permanent connection.

FIG. 7 illustrates yet another embodiment of a hinged electrical power outlet device intended for permanent electrical plug connectivity. It differs from previous hinged electrical power outlet assembly embodiments in that the electrical outlet assembly 13 can be positioned in the horizontal or least visible position when a line cord is connected or there is no connection. The electrical outlet assembly 13 mechanically detents in either of the two horizontal positions or the vertical position. The assembly is detented into the horizontal positions to ensure the electrical power outlet assembly 13 remains adjacent and parallel to the horizontal surface to which it is mounted in either the connected or disconnected position. The electrical power outlet assembly 13 is detented in the vertical position to permit a user to plug and unplug an electrical line cord with one hand. Detenting is accomplished by the action of the detent assembly spring 31 pushing the detent 32 toward the electrical power outlet assembly pivot shaft, mounting bracket 33. The detent pawl 34 engages one of the two horizontal positioning detent notches 35, or the vertical positioning detent notch 36, all of which are cut into the electrical power outlet assembly pivot shaft, mounting bracket 33.

The horizontal positioning detent notches 35 are shallow and only a portion of the detent pawl 34 enters the slot. Only moderate pressure is required to disengage the electrical power outlet assembly from either of the two horizontal positions.

The vertical positioning detent notch 36 is larger and accepts the full width of the detent pawl 34 and thus ensures a positive positioning that can be disengaged only when the user slides the detent handle downward, thus disengaging the detent pawl 34 from the vertical positioning detent notch 36. The positive interlocking formed by the relationship of the vertical positioning detent notch 36 and the detent pawl 34 is necessary to allow one-handed plugging and un-plugging of electrical line cords without imparting any motion of the electrical power outlet assembly 13.

The support module 37 contains two external modular power connectors 20. Either of the two external power connectors 20 may be utilized to connect to the building power network. The additional external power connector 20 may be used to supply power to another electrical interface module via an inter device cable assembly. A cable trough 38 and the cable bracket 39 provide a path for any building power cables to be routed from left to right or visa versa and ensures the cable will not interfere with normal use of the device.

Figure 8:
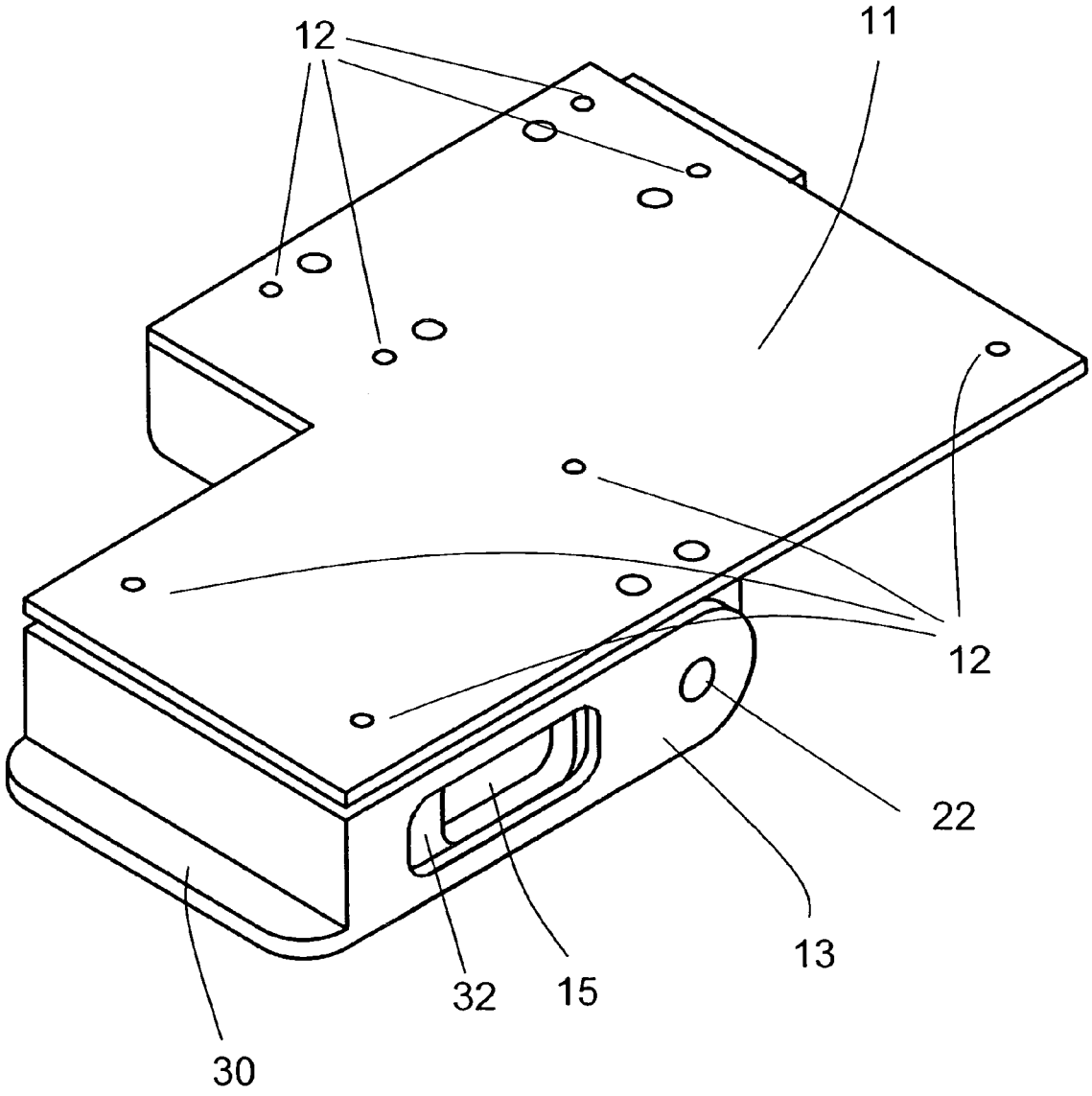
FIG. 8 is an isometric view of a folding electrical power outlet device suitable for permanent connection in the closed or unused position.

FIG. 8 shows the base mounting plate 11 of this embodiment which attaches to the underside or bottom of a horizontal surface and can be attached mechanically with screws passing through the mounting holes 12 or adhesively with double-sided construction tape. The electrical power outlet assembly 13 can be rotated 180 degrees from a forward facing horizontal position to a rearward facing horizontal position to the 90 degree or plug and un-plug position by pivoting it about the mounting pivot shaft 22 using the front handle 30 or the right side fingertip opening 15. Releasing the electrical power outlet assembly from the vertical or plug and un-plug position is accomplished by pushing the detent handle 32 downward. Two 110 Volt, three prong polarized plugs 14 are positioned on the face of the electrical power outlet assembly 13.

Figure 9:
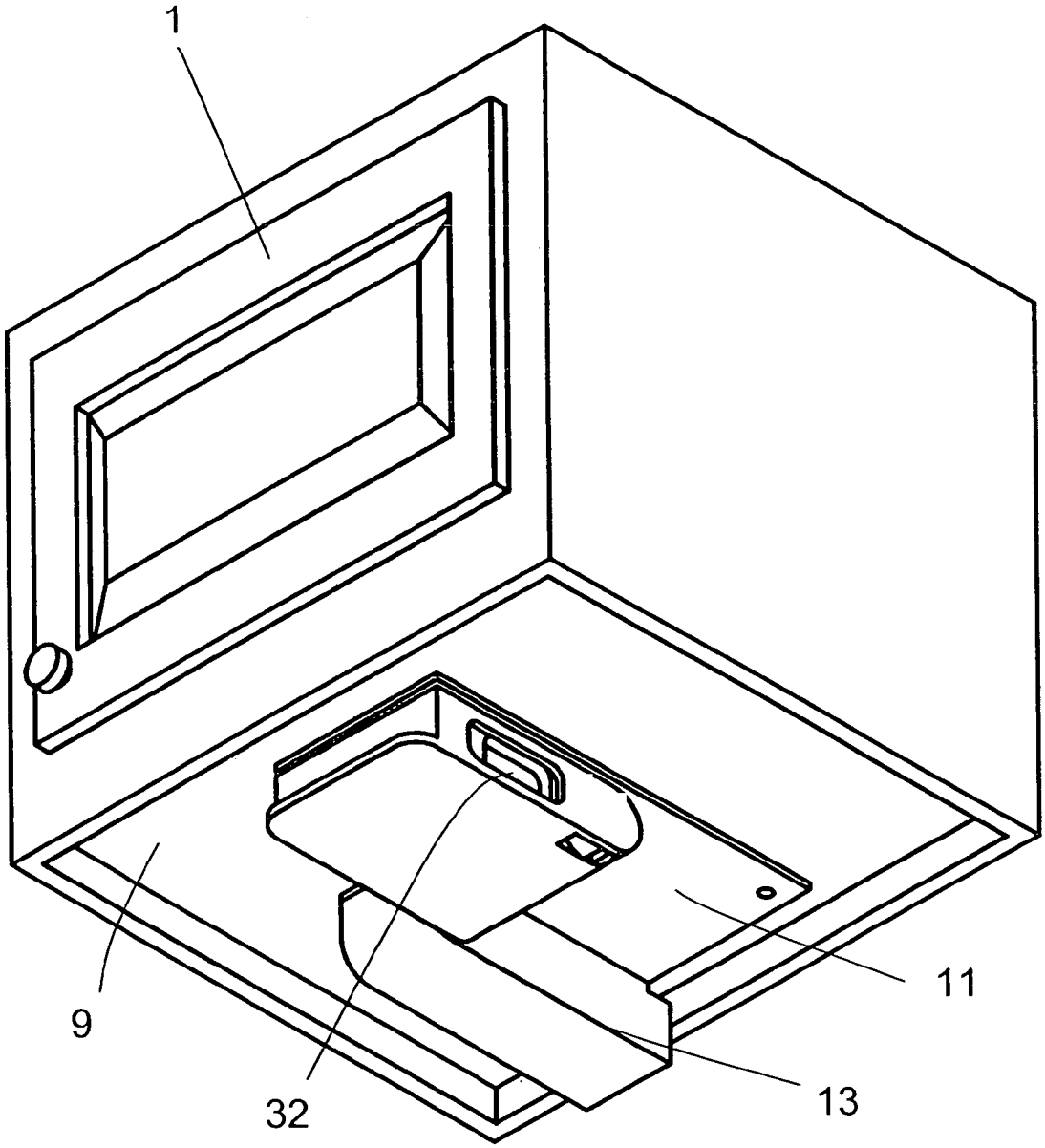
FIG. 9 is an isometric view of a folding electrical power outlet device suitable for permanent connection affixed to the bottom of a kitchen cabinet in the unused position.

FIG. 9, an isometric view, is of the hinged electrical power outlet device intended for permanent electrical plug connectivity mounted to the bottom surface 9 of an upper kitchen cabinet 1 in the unused position. The base mounting plate 11 is positioned, as far toward the rear of the cabinet as possible to ensure that when in use, attached electrical line cords will be less intrusive as they descend along the back splash at the rear of the cabinet. The electrical power outlet assembly 13 is placed in a forward facing horizontal position when the device is not in use and no electrical line cords are connected. This horizontal position reduces visibility of the device by exposing the thinnest profile, that being the vertical height of the electrical power outlet assembly 13. This positioning also ensures ease of use as the electrical power outlet assembly 13 and the detent handle 32 contained therein are easy to access from the normal user position, that being from in front of the device. When the device is to be used, the user inserts fingertips into the detent handle 32 and slides the handle forward to detach the detent and allow the electrical power outlet assembly 13 to rotate downward until the vertical position is attained.

Figure 9A:
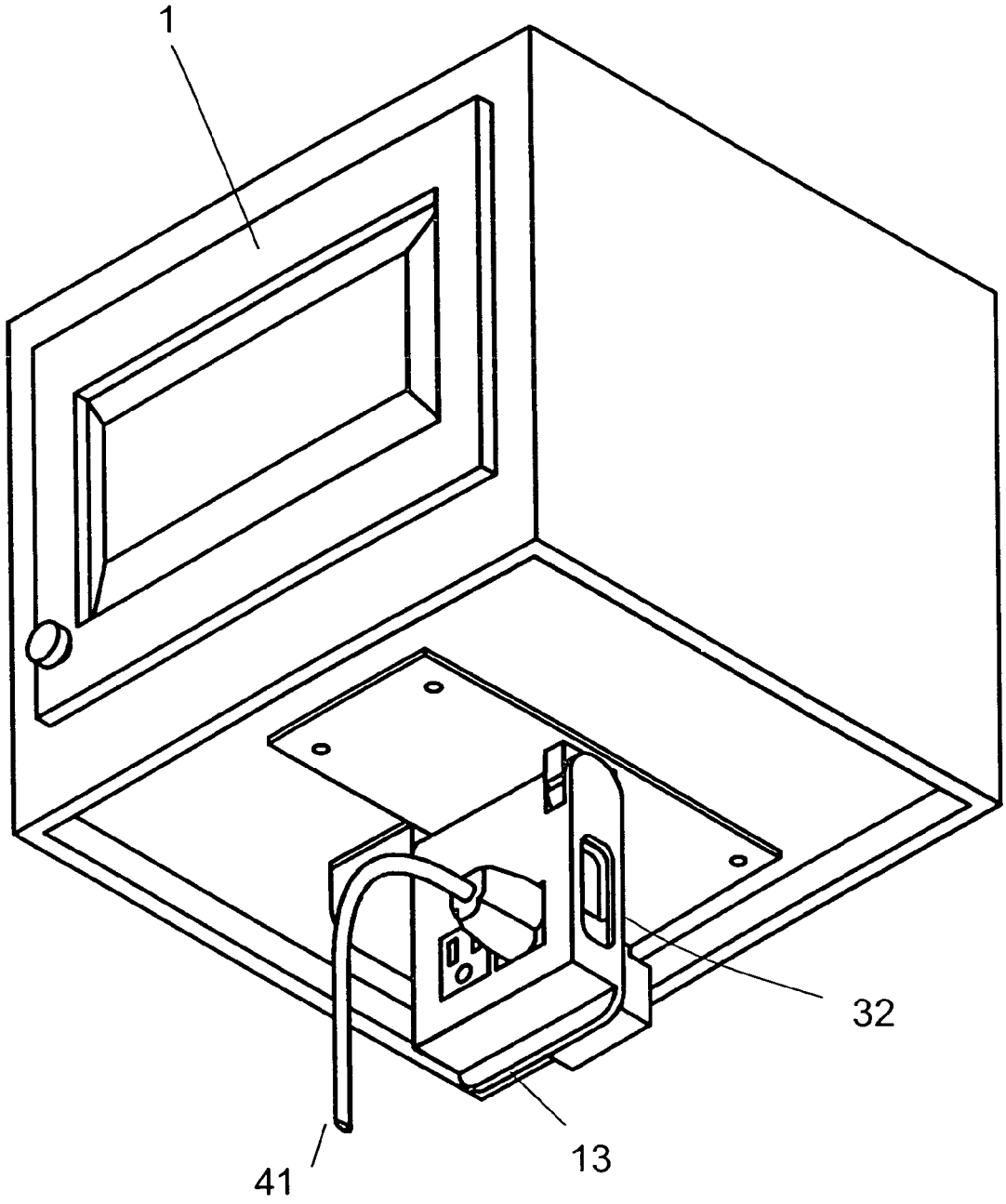
FIG. 9A is an isometric view of a folding electrical power outlet device suitable for permanent connection affixed to the bottom of a kitchen cabinet in the position used to plug and un-plug line cords.

As shown in FIG. 9A, after rotating the electrical power outlet assembly 13 to the vertical position, the spring-loaded detent handle 32 will latch the electrical power outlet assembly 13 at the vertical position so as to enable the user to place an electrical line cord 41 with one hand.

Although it is not the preferred use, the electrical power outlet assembly 13 may be left in the vertical placement at any time, either when in use or out of use if desired.

Figure 9B:
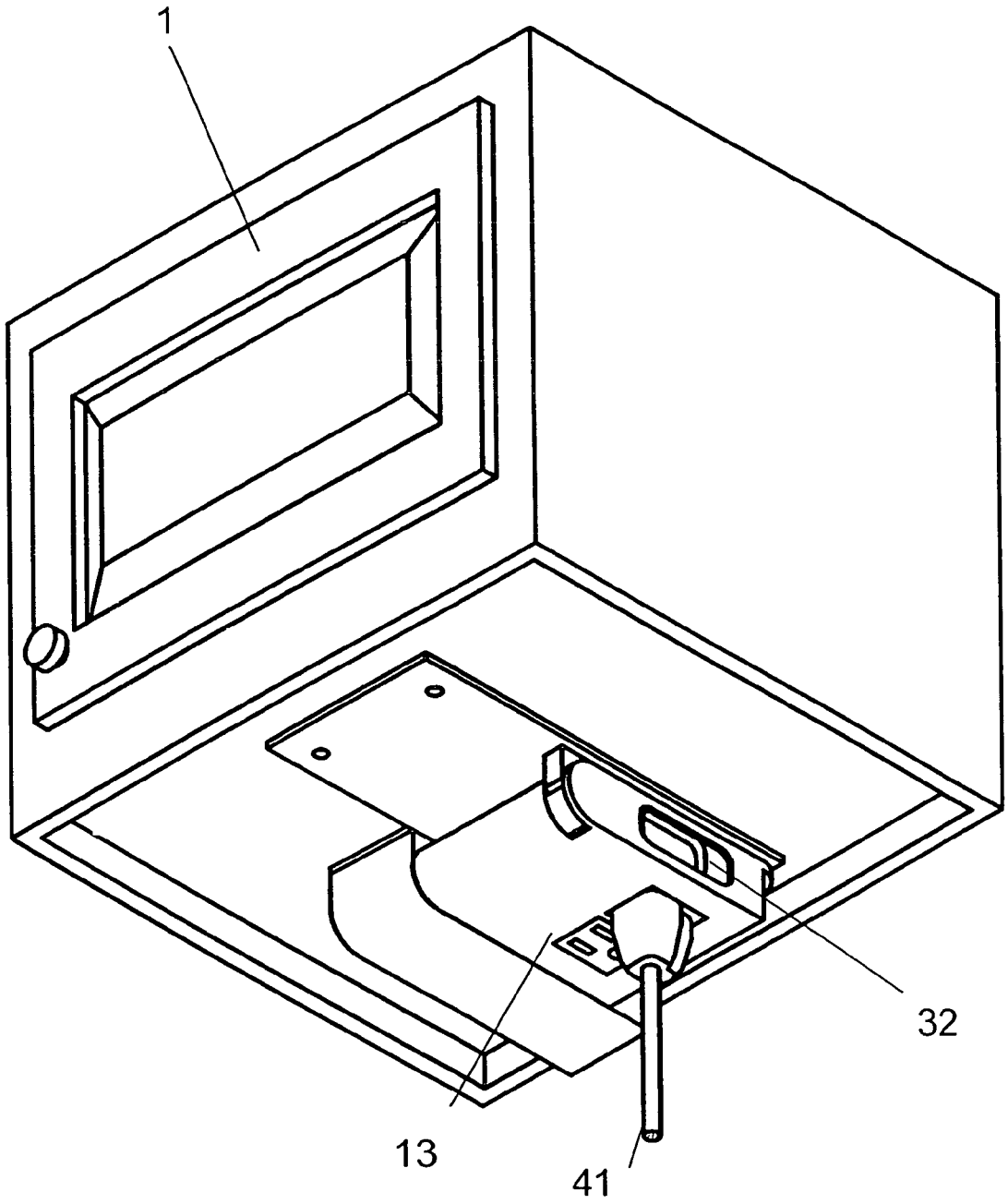
FIG. 9B is an isometric view of a folding electrical power outlet device suitable for permanent connection affixed to the bottom of a kitchen cabinet in the position used when a line cord is attached.

As shown in FIG. 9B, following the placement of an electrical line cord 41 the user may push the detent handle 32 in a downward position and rotate the electrical power outlet assembly 13 to the inside horizontal position. When the electrical power outlet assembly 13 is properly aligned the spring-loaded detent handle 32 will seat and lock the assembly in the horizontal position. While in this position, the electrical line cord 41 will be aligned near the backsplash in a vertical position and will therefore be less visually intrusive than it would be if positioned more toward the front of the cabinet 1.

Figure 9C:
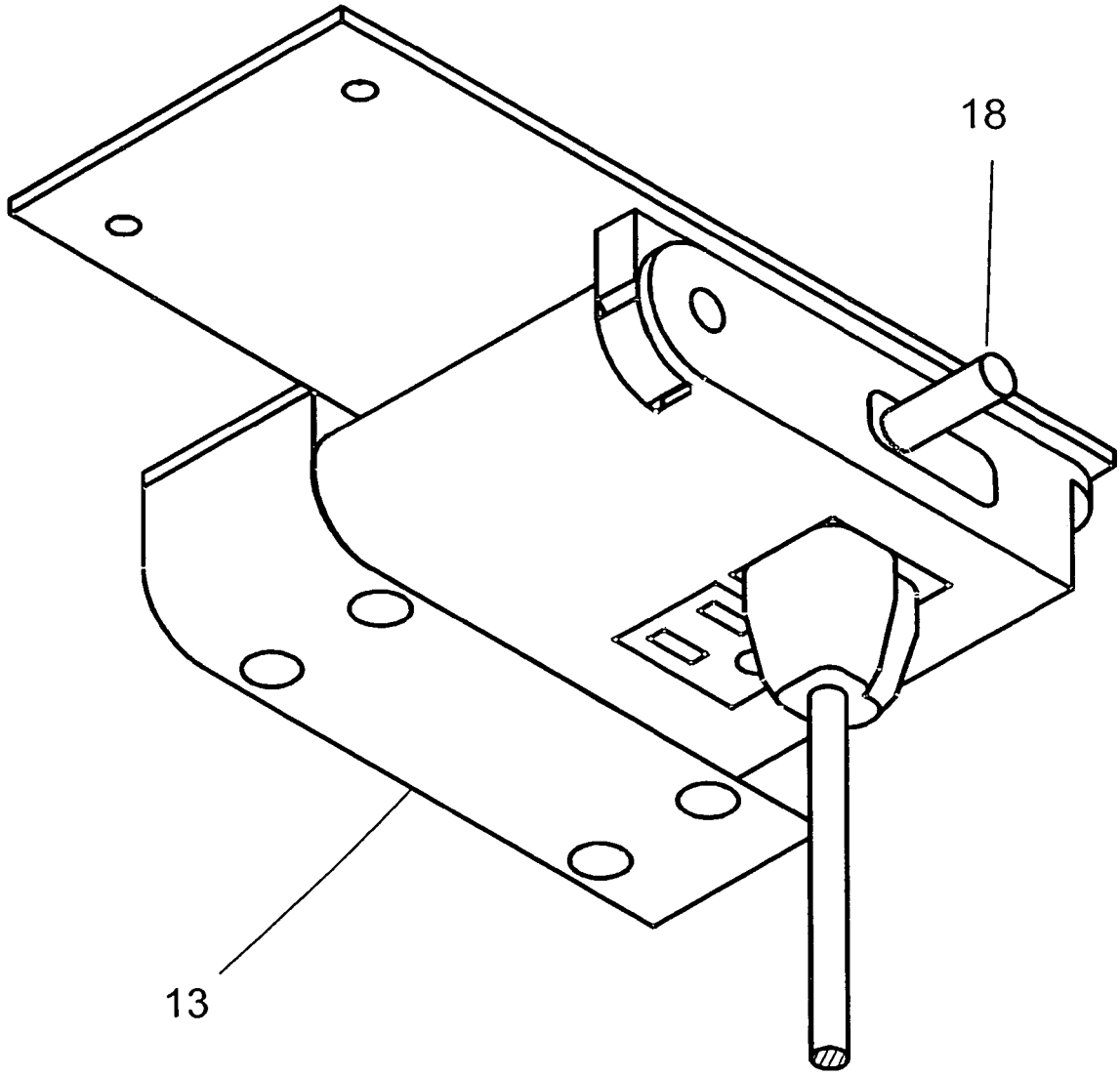
FIG. 9C is an isometric view of a folding electrical power outlet device suitable for permanent connection with an alternate detent handle style.

FIG. 9C illustrates another alternative style of detent handle 18. This is one of many alternatives to the finger-tip slot detent handles previously depicted. This style may be more desirable for those with physical impairments and would be easier to locate and use when the electrical power outlet assembly 13 is positioned to the rear and, therefore, furthest from the user.

Figure 10:
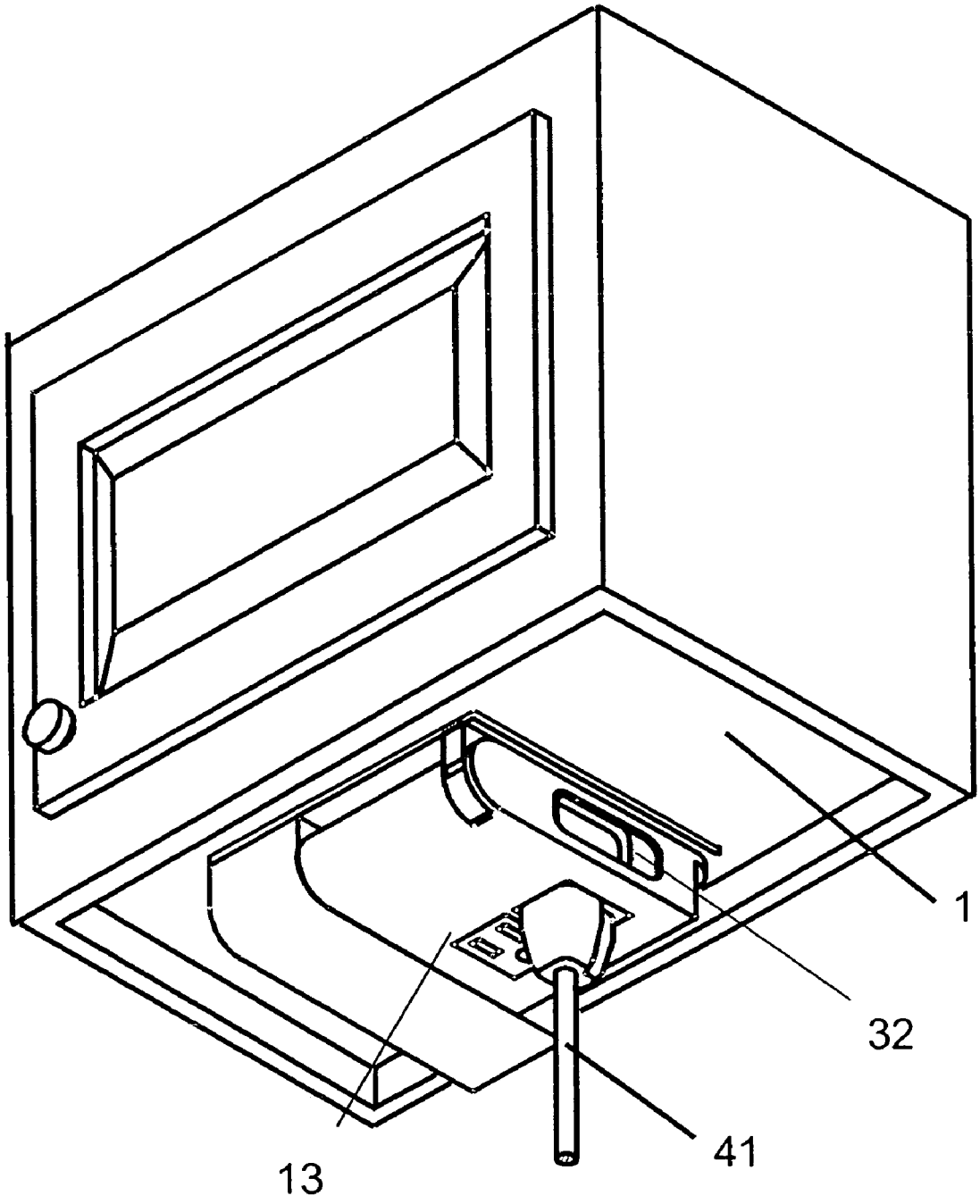
FIG. 10 is an isometric view of another embodiment of the folding electrical power outlet device suitable for permanent connection.

FIG. 10 is another embodiment of the hinged electrical power outlet device intended for permanent electrical plug connectivity. It differs from the original embodiment illustrated in FIGS. 7, 8, 9, 9A and 9B in that this embodiment is limited to 90 degrees of movement. In order to insert an electrical line cord, the electrical power outlet assembly 13 is positioned in a vertical position by pushing the detent handle 32 down and rotating the assembly in a forward and downward fashion until it reaches a vertical attitude, which exposes the electrical power outlets 14 toward the user. Releasing the spring-loaded detent handle then causes the electrical power outlet assembly 13 to latch in the vertical position. An electrical line cord can then be inserted with one hand when the electrical power outlet assembly 13 is in the vertical position. Following electrical line cord insertion, the electrical power outlet assembly 13 is rotated 90 degrees rearward and upward away from the operator until the electrical power outlet assembly 13 is parallel and abuts the base mounting plate 11. The spring-loaded detent handle 32 then latches the electrical power outlet assembly 13 in the horizontal position.

Figure 10A:
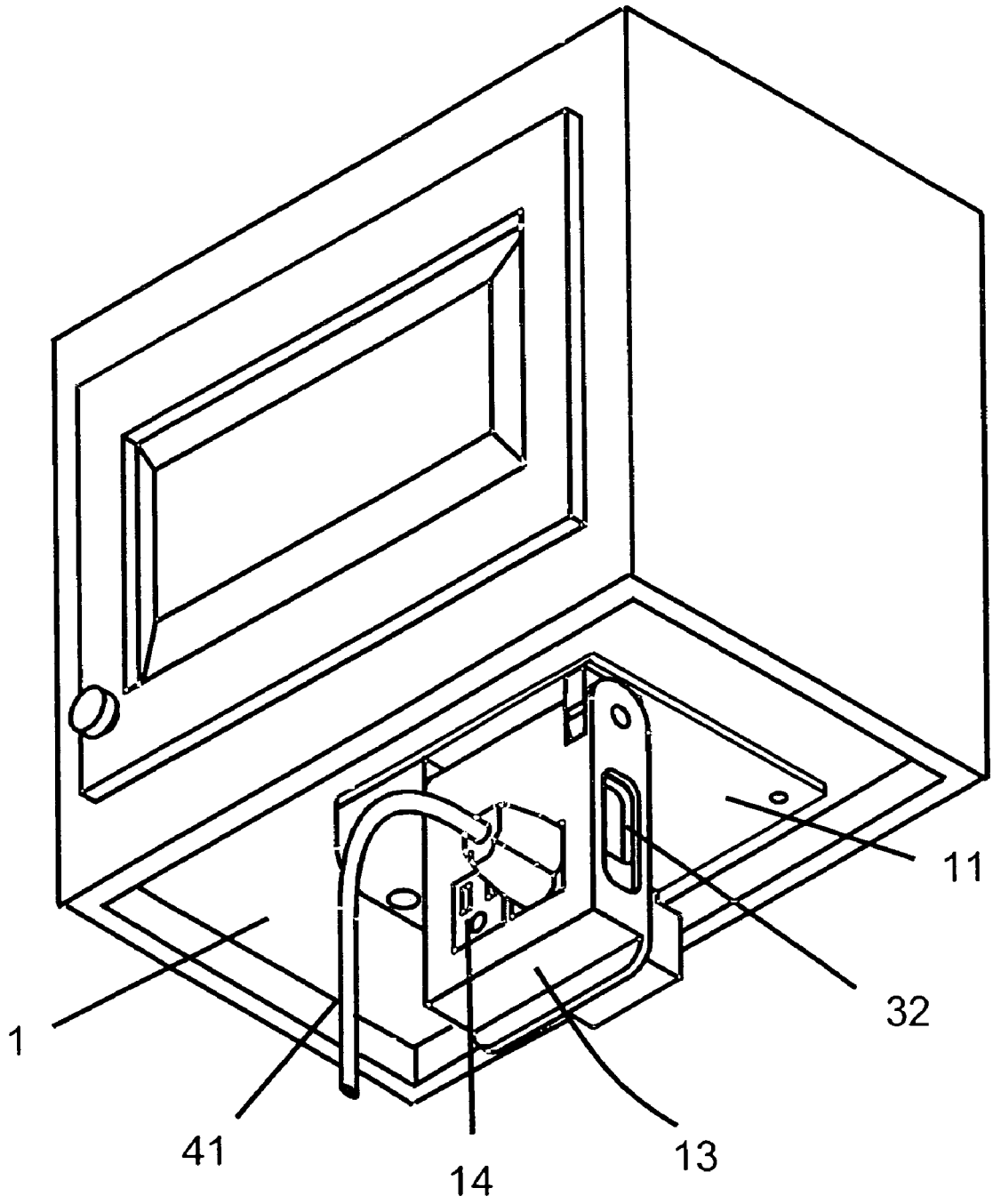
FIG. 10A is an isometric view of the embodiment described in FIG. 10 affixed to the bottom of a kitchen cabinet.

FIG. 10A illustrates the 90 degree embodiment of the hinged electrical power outlet device intended for permanent plug connectivity attached to the bottom of an upper kitchen cabinet 1 in the used or connected position with an electrical line cord 41 attached. A positive attribute of this embodiment is the reduced mounting footprint required for device installation that is derived from using a shortened base mounting plate 11.

Figure 10B:
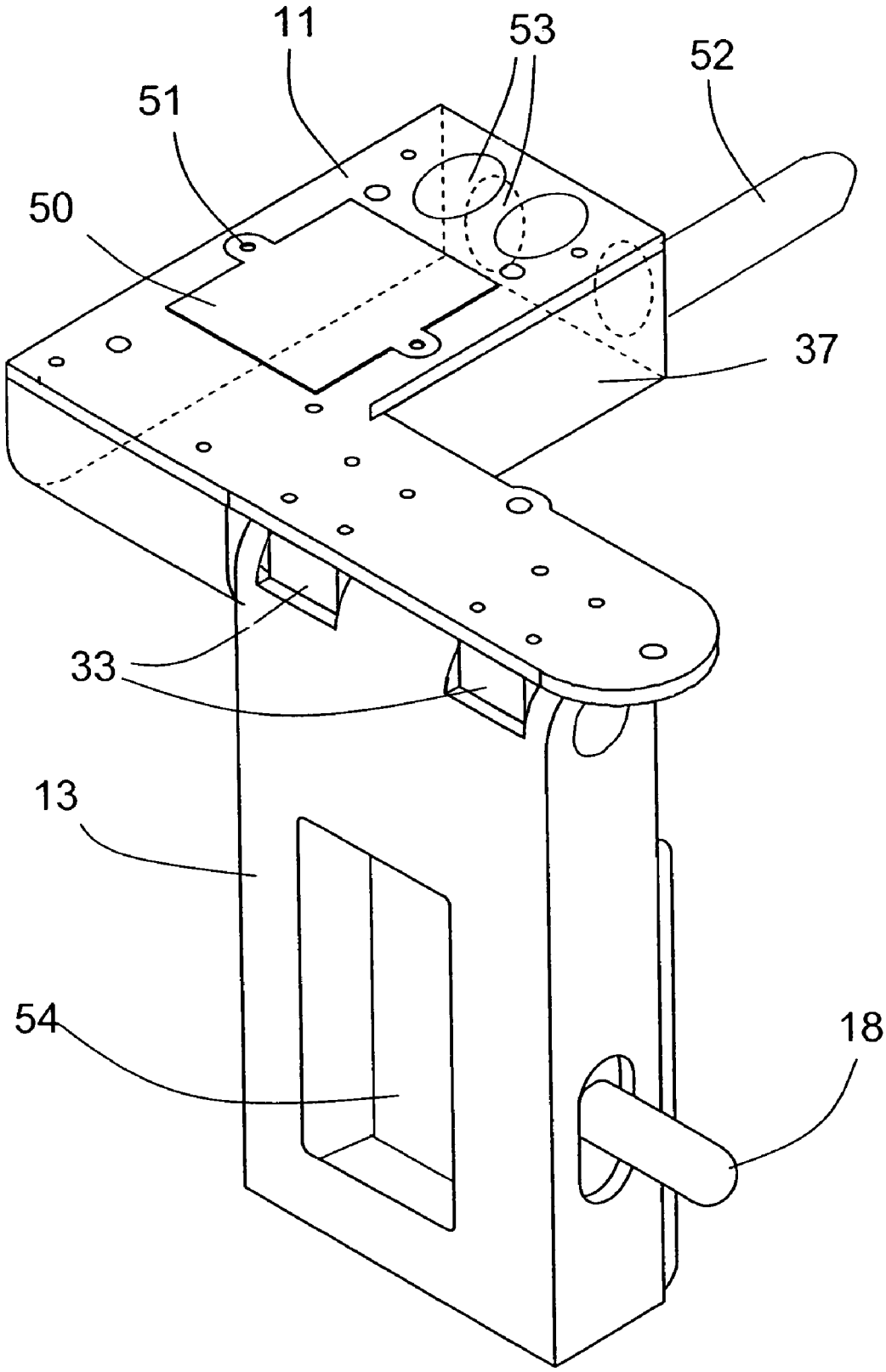
FIG. 10B is an isometric view of an additional embodiment of the folding electrical outlet device suitable for permanent connection.

FIG. 10B illustrates an additional embodiment which contains several refinements to the invention designed to rotate through a 90 degree arc. The base mounting plate 11 contains an access plate 50 which is attached to the base mounting plate 11 by 2 prongs and locking screws 51. Removal of the access plate 50 allows an installer to make electrical connections to building power within the support module 37. Provision for electrical circuit entry and exit are made by the addition of electrical knock-outs 53 that are cut into the base mounting plate 11 for access from above and into the back of the base module 37 for rear entry as depicted by the attached electrical conduit 52. Two mounting brackets 33 are used to form the pivot points from which the power outlet assembly is suspended. A user can unlatch the electrical power outlet assembly 13 by use of a detent handle 18 and rotate it 90 degrees from the vertical position shown to a position whereby the electrical fixture bay 54 is facing downward.

Any type of standard electrical fixture may be positioned inside of the electrical fixture bay 54.

Figure 10C:
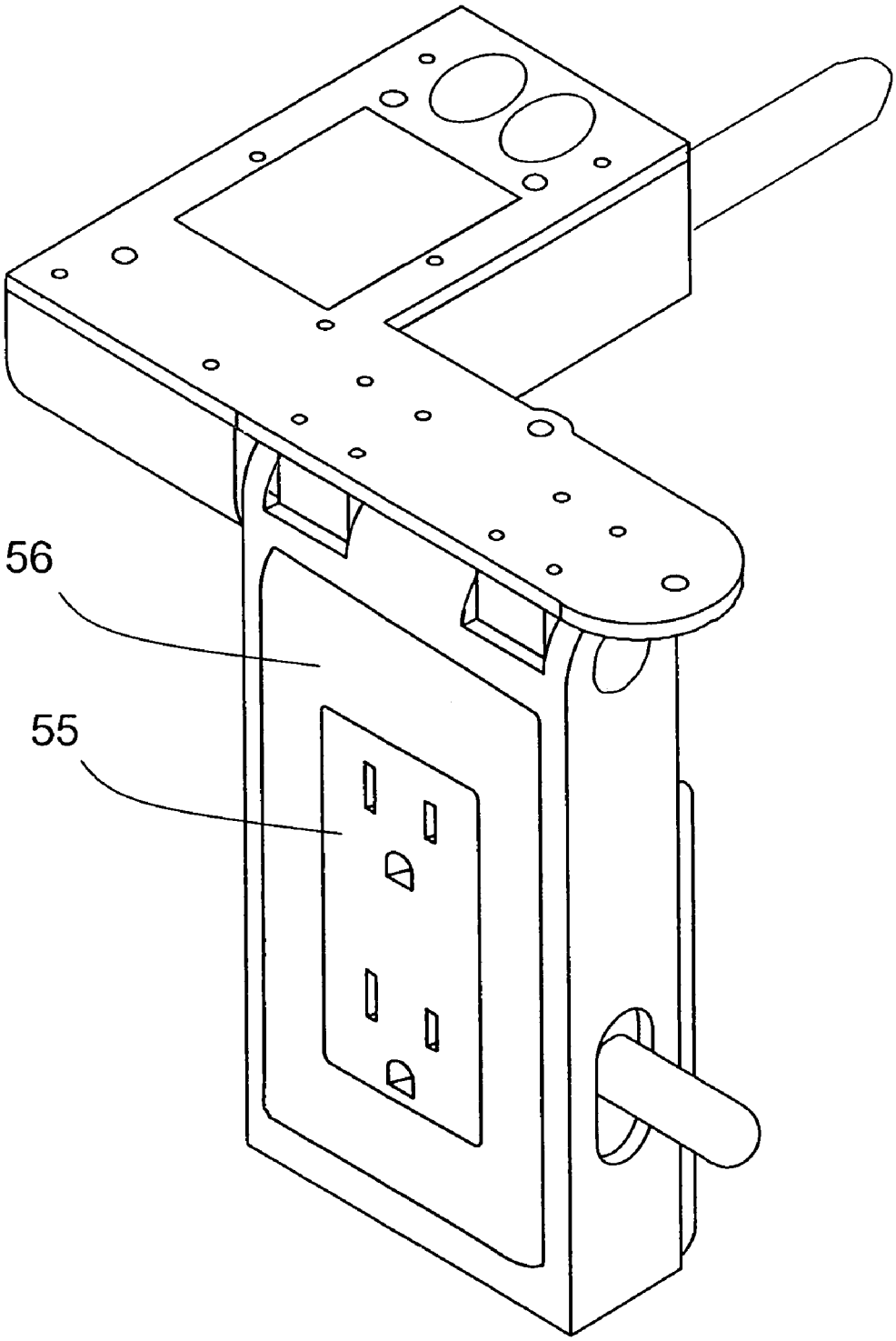
FIG. 10D is an isometric view of an additional and more robust embodiment of the folding electrical power outlet device suitable for permanent connection.

FIG. 10C is a perspective drawing of the same embodiment shown in FIG. 10B with an electrical fixture 55 and a cover plate 54 installed.

Figure 10D:
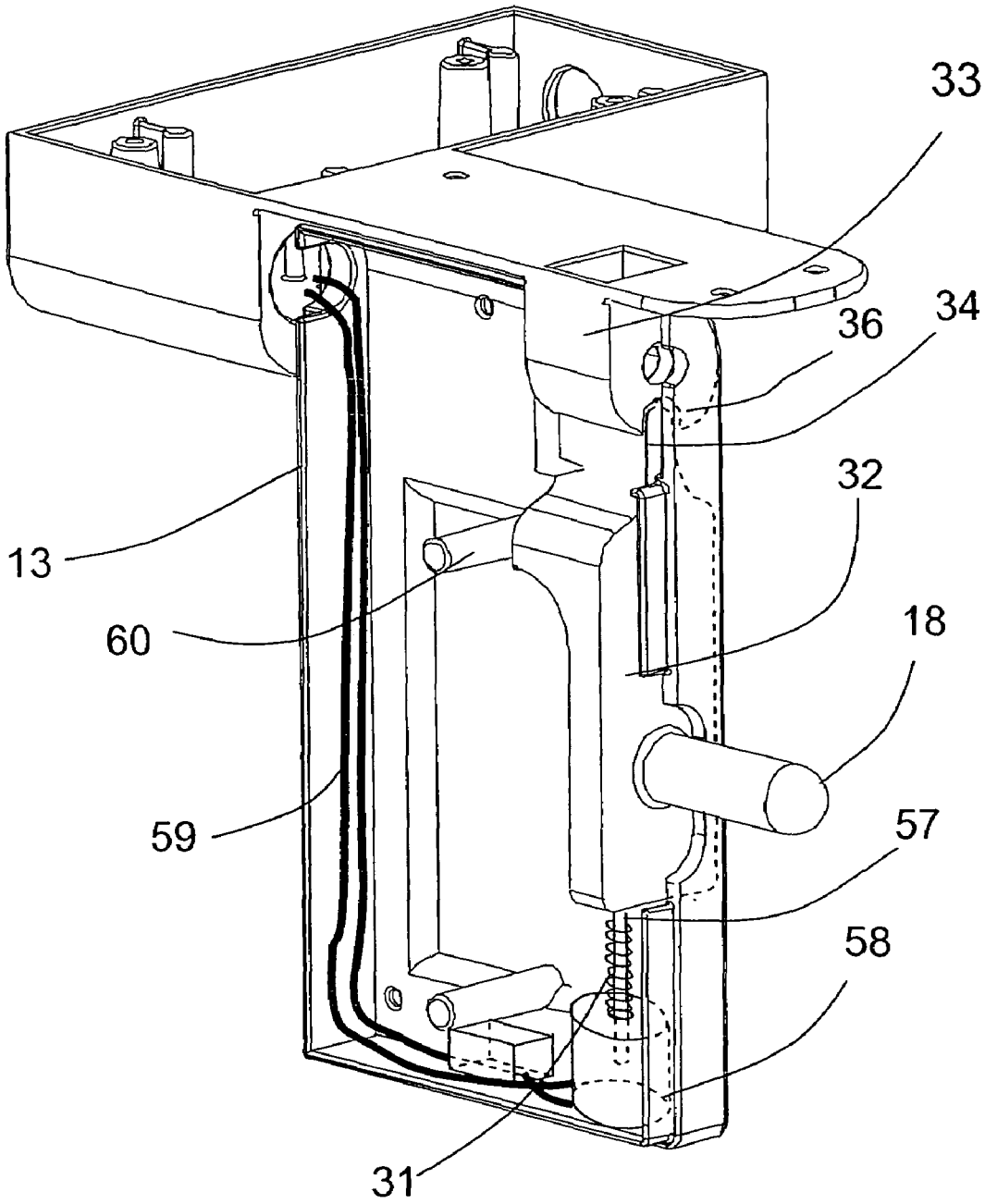

FIG. 10D depicts an additional embodiment of the invention. This embodiment utilizes a single and much wider mounting bracket 33. The wider mounting bracket 33 has a wider vertical positioning slot 36 and a correspondingly wider detent pawl 34 in order to better resist forces imparted on the electrical power outlet assembly 13 when excessive force is used to insert electrical plugs. The detent 32 is spring loaded to ensure proper engagement of the detent pawl 34 into the vertical positioning slot 36 by the detent spring 31. Users of the apparatus may rotate the electrical power outlet assembly by moving the detent handle 18 downward and extracting the detent pawl 34 from the vertical positioning slot 36.

A solenoid coil 58 surrounds the detent retraction rod 57. The detent retraction rod 57 is attached to the detent 32. When the solenoid coil 58 is energized the detent retraction rod 57 and attached detent 32 are drawn downward causing the detent pawl 34 to be withdrawn from the positioning slot. If the solenoid coil 58 is energized when the electrical power assembly 13 is in the horizontal position it will rotate downward to the vertical position thus bringing the assembly into view. The solenoid can be energized via a low voltage wired circuit or a radio frequency receiver emplaced in the low voltage wire 59 that is used to connect the solenoid coil 58 to its control circuit.

The fixture mounting standoffs 60 are shown. These fixtures are positioned to be compatible with standard sized electrical fixtures and enable the easy attachment of them.

FIG. 11 illustrates the hinged electrical lighting device for work area and accent lighting. This lighting module 19 traverses an arc of 180 degrees when rotated about the pivot shaft 22. The lighting module 19 is held in any position by use of a friction plate 25. When the lighting module 19 is positioned toward the cabinet front, the light source 23 faces downward toward the counter top. When the light is activated, by transferring the module light switch 27 the counter area will be illuminated and if desired, the user can reposition the lighting module 19 by changing the angle about the pivot shaft 22 to better illuminate the desired area.

A secondary use of the device is to direct light at any angle toward the backsplash or bounce the light off of the cabinet bottom by pivoting the lighting module 19 all the way to the back. This results in an indirect lighting configuration that can be used for alternate purposes such as accent lighting or a night-light. The light source used can be any of a multitude of light source types including Halogen, incandescent, Light Emitting Diodes (LEDs), or other alternatives. Optional cooling fins 28 may be included to heat sink a transformer if required to power a particular light source type.

Figure 12:
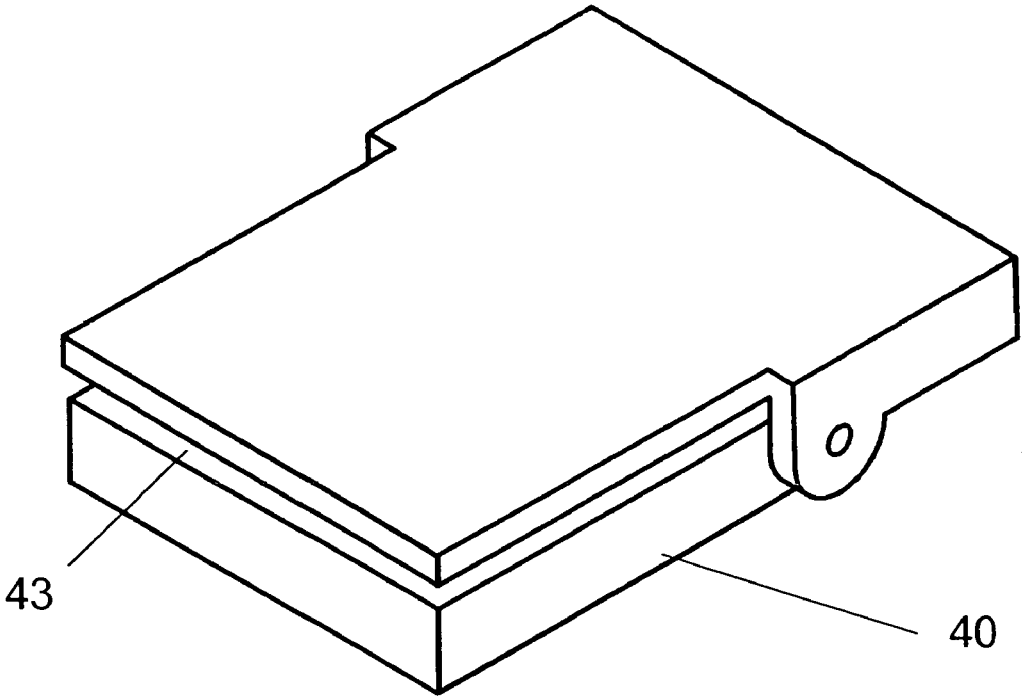
FIG. 12 illustrates an embodiment of the hinged device, which serves as an under cabinet holder for remote battery powered controllers in the closed or unused positions.

FIG. 12 depicts an embodiment of the hinged device, which serves as an under cabinet holder or mounting for remote battery powered wireless switches. Several manufacturers now offer adhesively attached switches that may be used to perform "wireless" appliance and lighting control. The adhesively attached switches offer the advantage of not having to physically wire them into the circuits they control and therefore allow complete flexibility in where they are located. Despite all of the advantages to this art, the wireless devices are just as unsightly when applied to a back splash as are the wired switches they replace. The described device is, therefore, proposed as a method of placing wireless switches and small wireless controllers in a concealed position when they are not in use.

The primary embodiment of this device uses no electrical power. The switch mounting module 40 is normally positioned in the horizontal position. When it is desired to operate a wireless switch 42 which has been affixed to the switch mounting module 40 the module is rotated downward to a vertical position. An alternative embodiment of this device would include a small replaceable battery, a low voltage light source and a tilt switch. These additions would provide illumination for the wireless switch when the device is rotated to the vertical position.

Figure 12A:
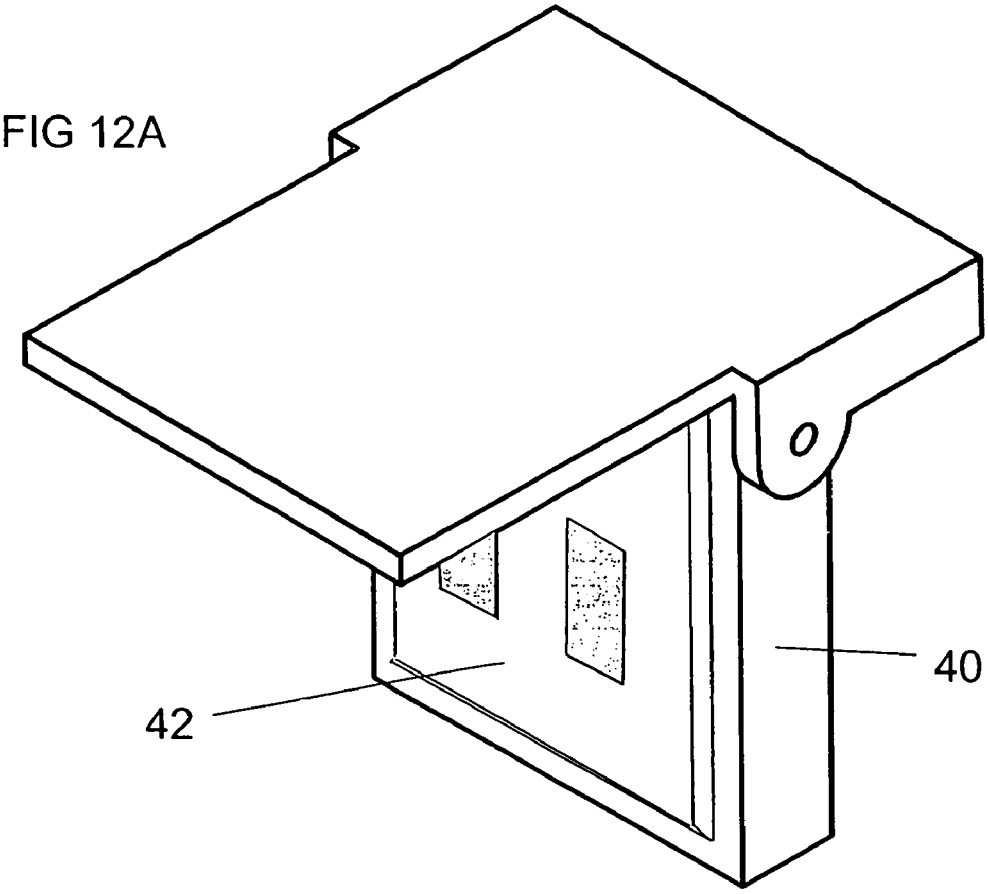
FIG. 12A illustrates an embodiment of the hinged device, which serves as an under cabinet holder for remote battery powered controllers in the usable or open positions.

FIG. 12A illustrates an under cabinet holder or mounting for remote battery powered wireless switches with the switch mounting module 40 in the vertical position with an adhesively affixed wireless switch 42.

Figure 13:
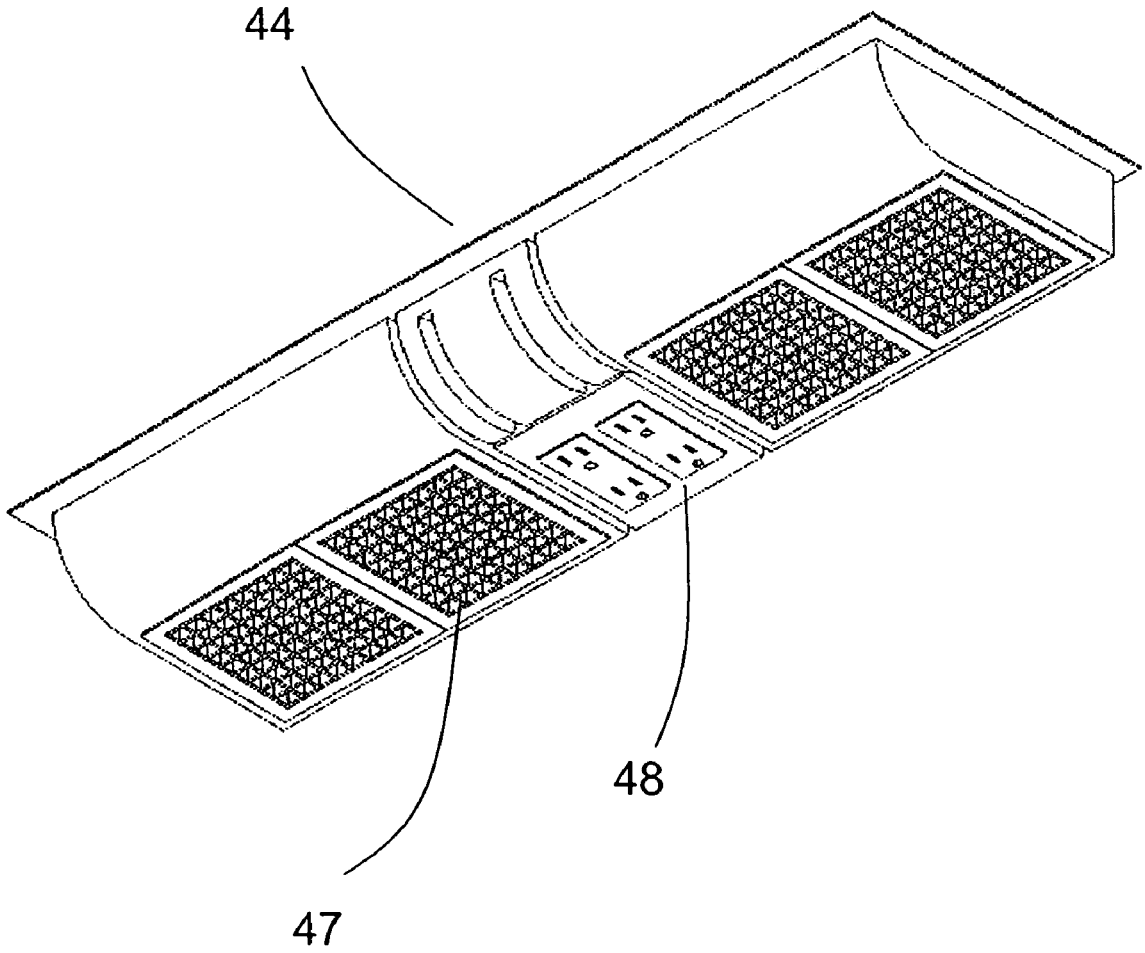
FIG. 13 illustrates an embodiment of the hinged device which provides countertop work area illumination and electrical outlets.

FIG. 13 illustrates an embodiment 44 of the hinged device 46 which provides countertop work area illumination through lamps 47. Such embodiment also provides electrical outlets 48. Included are one or more, preferably a plurality, of various electrical components of types including lamps, electrical outlets and telephone outlets and outlet cables for television and the internet.

The preceding description has been presented only to illustrate and describe the invention. It is not intended to be exhaustive or to limit the invention to any precise form disclosed. Many modifications and variations are possible in light of the above teaching. A multitude of embodiments were chosen and described in order to best explain the principles of the invention and their practical application. The preceding description is intended to enable others skilled in the art to best utilize the invention in various embodiments and with various modifications as are suited to the particular use contemplated. It is intended that the scope of the invention be defined by the following claims.

The devices claimed and described herein may be designed to meet and comply with different standards, building codes and requirements while still being within the state of the art as described herein. The base plate assemblies, moveable modules and other external accessories may be manufactured from various plastics, metals and resins. The exterior finish may have embedded colors, be painted or be metallically finished in order to match and compliment kitchen faucets and fixtures including stainless steel appliances. All description drawings contained herein illustrate the "right hand" version of all of the devices illustrated. It should be noted that the devices would be manufactured in right and left handed format to suit user preference as well as allow positioning in corners with walls abutting the device.

Other embodiments that would fit within this statement of the art are possible including modifying the hinging and latching mechanisms, changing the number or electrical outlet plugs to increase capacity or to reduce the device size and mounting footprint, moving the support module from the left to the right side, utilizing differing power cable connectivity and wiring methods, and other design and styling possibilities. In addition, the various classes of devices described herein may be combined by including the functionality of a multitude of class types within one device. An example of combining functions would be the inclusion of RJ-11 modular telephone connectivity on any of the embodiments of the electrical power outlet devices.

Moreover, the description and illustration of the invention is by way of example, and the scope of the invention is not limited to the exact details shown or described.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electrical outlet device comprising:

a mounting plate;

an electrical outlet assembly containing electrical components, the electrical outlet assembly having a pair of oppositely located sides and a face, the face having at least one electrical outlet set of openings;

a pair of oppositely located fingertip openings, the fingertip openings being located on the opposite sides of the electrical outlet assembly; and a hinge assembly coupled to the electrical outlet assembly and the mounting plate and adapted to enable the electrical outlet assembly to pivot with respect to the mounting plate between a raised horizontal orientation and a lowered operative orientation with the electrical outlets being accessible when the outlet assembly is in the raised position and when the outlet assembly is in the lowered position.

2. A retractable electrical power outlet device which mounts beneath horizontal surfaces and folds out of sight when not in use as set forth in claim 1 wherein the electrical power outlet assembly contains an end with a plurality of electrical outlet sockets positioned on the end and further including:

an electrical power input connector;

an electrical power output connector which allows interconnection to another concealable outlet device;

a locking mechanism to retain the outlet assembly in the horizontal position; and a hinged safety cover which guards against accidental contact with the electrical outlets when the device is not in use.

3. A hinged electrical lighting device which provides countertop work area illumination in one position and provides under-cabinet accent lighting when pivoted to the other position which mounts beneath cabinets and other horizontal surfaces and remains out of site at all times as set forth in claim 1 wherein the base mounting plate provides attachment to the mounted surface and wherein the hinge assembly enables the outlet assembly to swing rearward 180 degrees from a forward facing horizontal position and further including:

a lighting assembly selected from the class of lighting assemblies including an incandescent, Light Emitting Diode, Halogen and other light source assembly;

an electrical power input connector;

an electrical power output connector what allows interconnection to another under cabinet fixture;

a friction mechanism to hold the lighting assembly in any position throughout the 180-degree arc;

an on/off switch; and a dimming rheostat for dimmable light sources.

4. A folding electrical device which provides a moveable switch-mounting panel that can be wired to lights, fans, disposals and other such switch controlled items which mount beneath cabinets and other horizontal surfaces and remains out of site when it is not in use as set forth in claim 1 wherein the base mounting plate provides attachment to the mounted surface and wherein the hinge assembly enables the outlet assembly to swing rearward 90 degrees from a forward facing horizontal position and further including:

a switch assembly with at least one electrical switch mounted on the top of the assembly;

at least one electrical input connections; and a locking mechanism to latch the switch assembly in the unused position.

5. A folding electrical device which provides a moveable co-axial cable attachment point that can be used to connect televisions cameras and recorders to building cable networks which mounts beneath cabinets and other horizontal surfaces and remains out of site when it is not in use as set forth in claim 1 wherein the base mounting plate provides attachment to the mounted surface and wherein the hinge assembly enables the outlet assembly to swing rearward 180 degrees from a forward facing horizontal position and further including:

a co-axial cable assembly with at least one coaxial cable connectors mounted on the top of the assembly;

at least one co-axial input connections; and a locking mechanism to latch the co-axial assembly in the used and unused position.

6. A hinged electrical device which provides a moveable telephone modular connector and an Internet modular connector which mounts beneath cabinets and other horizontal surfaces and remains out of site when it is not in use as set forth in claim 1 wherein the base mounting plate provides mechanical and adhesive attachment to the mounted surface and wherein the hinge assembly enables the outlet assembly to swing rearward 180 degrees from a horizontal position and further including:

a co-axial cable assembly with at least one coaxial cable connectors mounted on the top of the assembly;

at least one telephone and Internet modular input connections; and a locking mechanism to latch the co-axial assembly in the used and unused position.

7. The hinged electrical power outlet device as set forth in claim 1 and further including mechanical fasteners to couple the mounting plate to a recipient surface.

8. The hinged electrical power outlet device as set forth in claim 1 and further including an adhesive to couple the mounting plate to a recipient surface.

9. The hinged electrical power outlet device as set forth in claim 1 and further including a cable trough and a cable bracket adapted to provide a path for any building power cable.

10. The hinged electrical power outlet device as set forth in claim 1 wherein the electrical components include pluralities of types of electrical components.

11. The hinged electrical power outlet device as set forth in claim 1 wherein the electrical components include lamps and electrical outlets.

12. The device as set forth in claim 1 wherein the hinge assembly has a hinge end about which the hinge assembly pivots and a free end, the free end including a surface perpendicular to the mounting plate when in a raised orientation with electrical outlet sockets therein and wherein the face is at an angle with respect to the mounting plate when in a lowered operative orientation.

13. A retractable electrical power outlet device suitable for permanent and long term connection which mounts beneath horizontal surfaces and folds out of sight when not in use as set forth in claim 1 wherein the base mounting plate provides attachment to the mounted surface and the an electrical power outlet assembly has a top and contains two electrical outlet sockets positioned on the top when it is in the unused position and wherein the hinge assembly enables the outlet assembly to swing downward 90 degrees from a forward facing horizontal position and further including:

an electrical power input connector;

an electrical power output connector that allows interconnection to another under cabinet fixture; and a locking mechanism to latch the outlet assembly in the horizontal position.

14. The hinged electrical power outlet device suitable for short-term use as set forth in claim 13 and further including a ground fault interrupter.

15. The hinged electrical power outlet device suitable for permanent and long term connection as set forth in claim 13 and further including a ground fault interrupter.

16. A retractable electrical power outlet device suitable for permanent connection which mounts beneath horizontal surfaces and is out of sight when in use and when not in use as set forth in claim 1 wherein the base mounting plate provides attachment to the mounted surfaced the electrical power outlet assembly has a top containing two electrical outlet sockets positioned on the top when it is in the unused position and the hinge assembly enables the outlet assembly to swing rearward 180 degrees from a forward facing horizontal position and further including:

an electrical power input connector; and an electrical power output connector what allows interconnection to another under cabinet fixture.

17. The hinged electrical power outlet device suitable for permanent and long term connection as set forth in claim 16 and further including a ground fault interrupter.

18. A retractable electrical power outlet device suitable for permanent connection which mounts beneath horizontal surfaces and is out of sight when in use and when not in use and requires a reduced mounting footprint as set forth in claim 1 wherein the base mounting plate provides attachment to the mounted surface and the electrical power outlet assembly has a top containing three electrical outlet sockets positioned on the top of the assembly when it is in the unused position and wherein the hinge assembly enables the outlet assembly to swing rearward 180 degrees from a forward facing horizontal position and further including:

an electrical power input connector;

an electrical power output connector that allows interconnection to another under cabinet fixture; and a detent mechanism to latch the outlet assembly in both horizontal positions and the vertical position.

19. The hinged electrical power outlet device suitable for permanent and long term connection with a reduced mounting footprint as set forth in claim 18 and further including a ground fault interrupter.

* * * * *